US008808020B2

(12) United States Patent
Ikari

(10) Patent No.: US 8,808,020 B2
(45) Date of Patent: Aug. 19, 2014

(54) ELECTRICAL CONNECTOR WITH RELEASING MEMBER

(75) Inventor: Hiroharu Ikari, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 123 days.

(21) Appl. No.: 13/531,020

(22) Filed: Jun. 22, 2012

(65) Prior Publication Data

US 2012/0329300 A1 Dec. 27, 2012

(30) Foreign Application Priority Data

Jun. 22, 2011 (JP) ..... 2011-138125
Mar. 16, 2012 (JP) ..... 2012-059933

(51) Int. Cl.
*H01R 13/62* (2006.01)

(52) U.S. Cl.
USPC ..... 439/328; 439/153

(58) Field of Classification Search
USPC ..... 439/153, 260, 495, 493, 269.2, 329, 439/328, 607.46
See application file for complete search history.

(56) References Cited

U.S. PATENT DOCUMENTS 7,625,231 B2 * 12/2009 Takahira ..... 439/495
7,850,473 B1 * 12/2010 Ozeki ..... 439/260
8,002,567 B2 * 8/2011 Hara ..... 439/329
8,235,739 B2 * 8/2012 Hashimoto ..... 439/328
8,337,226 B2 * 12/2012 Yokoo ..... 439/260
8,337,230 B1 * 12/2012 Kurachi ..... 439/328
8,435,059 B2 * 5/2013 Honda et al. ..... 439/260
2011/0086541 A1 * 4/2011 Hashimoto ..... 439/492
2011/0136365 A1 * 6/2011 Hara ..... 439/329
2012/0064749 A1 * 3/2012 Hashimoto ..... 439/329

FOREIGN PATENT DOCUMENTS

| | | |
|---|---|---|
| JP | 10-154550 | 6/1998 |
| JP | 10-302893 | 11/1998 |
| JP | 11-162566 | 6/1999 |
| JP | 2002-190351 | 7/2002 |
| JP | 2008-052993 | 3/2008 |
| JP | 2008-192574 | 8/2008 |
| JP | 2011-040246 | 2/2011 |

* cited by examiner

*Primary Examiner* — Hae Moon Hyeon
(74) *Attorney, Agent, or Firm* — Studebaker & Brackett PC

(57) ABSTRACT

An electrical connector including a housing having an opening through which a flat circuit device is inserted into the housing, conductive contacts arranged on the housing, a conductive shell provided with a holding member for engaging with the flat circuit device to hold the same, and a releasing member provided on the housing with a manipulatable portion and a pressing portion for engaging with the holding member, wherein the manipulatable portion is formed to be movable in a direction along which the conductive contacts are arranged and the pressing portion is operative to move for pressing the holding member so as to cause the same to disengage from the flat circuit device when the manipulatable portion is moved in the direction along which the conductive contacts are arranged under a condition wherein the holding member is put in engagement with the flat circuit device to hold the same.

13 Claims, 16 Drawing Sheets

ELECTRICAL CONNECTOR WITH RELEASING MEMBER

BACKGROUND OF THE INVENTION

1. Field of the Invention

The present invention relates generally to an electrical connector, and more particularly to an improvement in an electrical connector which has a housing in which a flat circuit device, such as a flexible printed circuit board (hereinafter, referred to as an FPC) or a flexible flat cable assembly (hereinafter, referred to as an FFC), is inserted, a plurality of conductive contacts arranged in the housing for coming into press-contact with connecting terminals provided on the flat circuit device inserted in the housing, holding means for engaging with the flat circuit device inserted in the housing so as to hold the same to be prevented from getting out of the housing unwillingly and releasing means for releasing the flat circuit device from holding by the holding means.

2. Description of the Prior Art Including Information Disclosed Under 37 CFR 1.97 and 37 CFR 1.98

A flat circuit device, such as a relatively small-sized FPC or FFC, used in electronic apparatus of various kinds is often mounted on a main solid circuit board, on which various electrical parts are directly mounted, with an electrical connector which is mounted to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to connect electrically each of the connecting terminals provided on the flat circuit device, through the conductive contacts, with the conductive circuit pattern portion formed on the main solid circuit board.

A first type of previously proposed electrical connector used for mounting a flat circuit device, such as an FPC, on a main solid circuit board, is provided with a housing made of insulator, which is mounted on the main solid circuit board and has an opening through which at least a part of the flat circuit device is inserted into the housing. In the housing, a plurality of conductive contacts are provided to be arranged along the opening and connected electrically with circuit terminals provided on the main solid circuit board. These conductive contacts are operative to come into contact respectively with a plurality of connecting terminals provided on the flat circuit device when the flat circuit device is inserted into the housing through the opening provided thereon. The previously proposed electrical connector of the first type is also provided with a conductive shell which covers partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in the press-contact with the connecting terminals provided on the flat circuit device, the flat circuit device is put in electrical connection with the main solid circuit board.

A second type of previously proposed electrical connector used for mounting the flat circuit device on the main solid circuit board is provided with a housing mounted on the main solid circuit board, a plurality of conductive contacts and a conductive shell in such a manner as mentioned above but is not provided with an actuator rotatable in regard to the housing. In the previously proposed electrical connector of the second type, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the above-mentioned previously proposed electrical connector with or without the actuator rotatable in regard to the housing, when the flat circuit device is inserted into the housing through the opening provided thereon and the conductive contacts provided in the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

There has been also proposed previously an electrical connector belonging to the above-described first type having the housing, the conductive contact, the conductive shell and the actuator, which is provided with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-52993 (hereinafter, referred to as published patent document 1).

In addition, there has been further proposed previously an electrical connector belonging to the above-described second type having the housing, the conductive contact and the conductive shell, which is provided with holding means for engaging with a flat circuit device, such as an FPC or an FFC, inserted in the housing so as to hold the same to be prevented from getting out of the housing unwillingly, as shown in, for example, each of the Japanese patent application published before examination under publication number 2008-192574 (hereinafter, referred to as published patent document 2) and the Japanese patent application published before examination under publication number 2011-40246 (hereinafter, referred to as published patent document 3).

In the electrical connector shown in published patent document 1, the holding means (a locking portion 11*c*) is formed in a part of the conductive shell (a shield plate 11) to be able to seesaw with an engaging end portion (a nail portion 11*d*) curved to the inside of the conductive shell. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34) provided in the housing, each of the conductive contacts (first contacts 5, second contacts 6) provided in the housing is caused to shift its position by a cam (a cam portion 92 or 93) formed on the actuator so as to be put in press-contact with a corresponding one of connecting terminals provided on the flat circuit device inserted in the housing and the holding means is caused to shift its position by a com (a cam portion 94) formed on the actuator so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means engages with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in published patent document 2, the conductive shell (a shell 4) is provided to be rotatable to the housing (a housing body 2) and the holding means (a leg portion 46) in the form of a leaf spring is formed in a part of the conductive shell. The holding means has an engaging projection (44) formed at an end of the holding means to be curved to the inside of the conductive shell.

When the flat circuit device (an FPC) is inserted into the housing through the opening (an opening 21) provided thereon under a condition wherein the conductive shell is positioned to keep lying down on the housing so as to be close in its entirety to the housing, each of the conductive contacts (upper contacts 31, lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the conductive shell is rotated to be positioned to keep rising from the housing under a condition wherein the engaging projection formed on the holding means is put in engagement with the engaging portion formed on the flat circuit device, the holding means formed in the conductive shell shifts its position in response to a movement of the conductive shell so as to release the engaging projection provided on the holding means from the engagement with the engaging portion formed on the flat circuit device. As a result, the flat circuit device is put in a condition to be able to get out of the housing.

In the case of the previously proposed electrical connector disclosed in published patent document 1, which has the holding means operative to shift its position in response to the rotational movements of the actuator provided to be rotatable in regard to the housing, the actuator provided to be rotatable in regard to the housing is required and this results in problems or disadvantages that the number of constitutive parts of the electrical connector increases undesirably and a production cost of the electrical connector rises disagreeably.

Further, it is necessary for causing the holding means to engage with or disengage from the flat circuit device inserted in the housing to rotate the actuator in regard to the housing and this results in undesirable increase in an open space around the electrical connector. Besides, since the conductive shell is shaped to cover only an upper surface of the housing opposite to a lower surface of the same facing the main solid circuit board and side surfaces of the housing opposite each other in the direction along which the conductive contacts are arranged, a contribution by the conductive shell to the adjustment on characteristic impedance of each of the conductive contacts is inevitably reduced and a shielding effect by the conductive shell to the conductive contacts against the electromagnetic wave noises can not be obtained sufficiently.

In the case of the previously proposed electrical connector disclosed in published patent document 2, which has the conductive shell provided to be rotatable in regard to the housing and the holding means formed in the part of the conductive shell, since the conductive shell is operative to rotate in regard to the housing, any part of the conductive shell can not be used for fastening the electrical connector to the main solid circuit board so that a separate holding-down member for fastening the electrical connector to the main solid circuit board is required and this results in problems or disadvantages that the number of constitutive parts of the electrical connector increases undesirably and a production cost of the electrical connector rises disagreeably. In addition, in this case also, since the conductive shell provided to be rotatable in regard to the housing is shaped to cover only an upper surface of the housing opposite to a lower surface of the same facing the main solid circuit board and side surfaces of the housing opposite each other in the direction along which the conductive contacts are arranged, a contribution by the conductive shell to the adjustment on characteristic impedance of each of the conductive contacts is inevitably reduced and a shielding effect by the conductive shell to the conductive contacts against the electromagnetic wave noises can not be obtained sufficiently.

On the other hand, in the electrical connector shown in published patent document 3, the conductive shell (a conductive shell 14) for covering partially an outside surface of the housing (a housing 11) is provided with the holding means (a locking member 20) formed to extend into the housing for holding the flat circuit device (an FPC 40) inserted in the housing through the opening (an opening 12) provided thereon. Further, the housing is provided with the releasing means (a releasing member 30) formed in a body on the housing to be movable with a first end portion projecting from the inside of the housing toward the outside of the conductive shell and a second end portion engaging with the holding means.

The holding means has an engaging projection (23) formed to be put in engagement with an engaging edged recess (43; 44) provided on the flat circuit device inserted in the housing for holding the flat circuit device and a resilient arm portion (22) for supporting the engaging portion to be shiftable in position. The second end portion of the releasing means is operative to engage with the resilient arm portion of the holding means.

On the side of an upper surface of the housing (a surface of the housing opposite to a lower surface of the housing facing a solid circuit board on which the housing is mounted.), the first end portion of the releasing means projects upward from the housing toward the outside of the conductive shell covering the upper surface of the housing.

Then, when the flat circuit device is inserted into the housing through the opening provided thereon, the engaging portion of the holding means is put in engagement with the engaging edged recess provided on the flat circuit device inserted in the housing to hold the flat circuit device. As a result, the flat circuit device inserted in the housing is prevented from getting out of the housing unwillingly.

After that, when the first end portion of the releasing means projecting upward from the housing toward the outside of the conductive shell is pushed down toward the inside of the conductive shell, the second end portion of the releasing means engages with the resilient arm portion of the holding means to cause the same to shift in position so that the engaging portion supported by the resilient arm portion of the holding means is shifted in position to disengage from the engaging edged recess provided on the flat circuit device. As a result, the engaging portion of the holding means is released from the engagement with the engaging edged recess provided on the flat circuit device and thereby the flat circuit device inserted in the housing is put in a condition to be able to get out of the housing.

With the previously proposed electrical connector, in which the conductive shell is provided with the holding means formed to extend into the housing for holding the flat circuit device and the housing is provided with the releasing means formed in a body on the housing to be movable, as disclosed in published patent document 3, the disadvantages encountered with each of the previously proposed electrical connector disclosed in published patent document, which has the actuator provided to be rotatable in regard to the housing and the holding means formed on a part of the conductive shell, and the previously proposed electrical connector disclosed in published patent document 2, which has the conductive shell provided to be rotatable in regard to the housing and the holding means formed on a part of the conductive shell, are desirably avoided.

However, in the electrical connector proposed previously, as disclosed in published patent document 3, to be used for mounting the flat circuit device, such as the FPC, on the solid circuit board, which has the conductive shell provided with the holding means formed to extend into the housing for holding the flat circuit device and the housing provided with the releasing means formed in a body on the housing to be movable, the first end portion of the releasing means projects upward from the housing toward the outside of the conductive shell and it is necessary to push down the first end portion of the releasing means projecting upward from the housing when the flat circuit device inserted in the housing is released from holding by the holding means. Therefore, it is difficult to reduce a measure of the housing including the first end portion of the releasing means in a direction perpendicular to each of the upper and lower surfaces of the housing, that is, a measure of the housing in its thickness, sufficiently to obtain a thin circuit board assembly, and this may prevent each of various electrical or electronic parts mounted on the solid circuit board from being reduced in a measure of thickness.

Further, in the electrical connector proposed previously to be disclosed in published patent document 3, since a manipulation for pushing down the first end portion of the releasing means projecting upward from the housing is required to cause the flat circuit device inserted in the housing to be released from the holding by the holding means. It is necessary to keep an open space enough to conduct the manipulation for pushing down the first end portion of the releasing means above the first end portion of the releasing means projecting upward from the housing. Consequently, the electrical connector proposed previously to be disclosed in published patent document 3 is not able to be put in practical use under a condition wherein, when the housing is mounted on the solid circuit board, the open space enough to conduct the manipulation for pushing down the first end portion of the releasing means can not be obtained above the first end portion of the releasing means projecting upward from the housing on the solid circuit board.

BRIEF SUMMARY OF THE INVENTION

Accordingly, it is an object of the present invention to provide an electrical connector used for mounting a flat circuit device, such as an FPC or an FFC, on a solid circuit board, which comprises a housing made of insulator to be mounted on the solid circuit board and provided with an opening through which a flat circuit device is inserted into the housing, a plurality of conductive contacts provided to be arranged on the housing, and a conductive shell covering partially the housing, and which avoids the aforementioned disadvantages encountered with the prior art.

Another object of the present invention is to provide an electrical connector used for mounting a flat circuit device, such as an FPC or an FFC, on a solid circuit board, which comprises a housing made of insulator to be mounted on the solid circuit board and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing with a relatively small number of constitutive parts of the electrical connector lacking an actuator provided to be rotatable in regard to the housing and a conductive shell set to be rotatable in regard to the housing and thereby resulting in a reduced production cost of the electronic connector.

A further object of the present invention is to provide an electrical connector used for mounting a flat circuit device, such as an FPC or an FFC, on a solid circuit board, which comprises a housing made of insulator to be mounted on the solid circuit board and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing under a condition wherein a measure of thickness of the housing in a direction perpendicular to the solid circuit board on which the housing is mounted can be reduced sufficiently to obtain a thin circuit board assembly.

A still further object of the present invention is to provide an electrical connector used for mounting a flat circuit device, such as an FPC or an FFC, on a solid circuit board, which comprises a housing made of insulator to be mounted on the solid circuit board and provided with an opening through which a flat circuit device is inserted into the housing, a plurality of conductive contacts provided to be arranged on the housing, and a conductive shell covering partially the housing, and in which the flat circuit device inserted in the housing can be surely put in holding to be prevented from getting out of the housing unwillingly and then released from the holding so as to be able to get out of the housing under a condition wherein an open space enough to conduct a manipulation for releasing the flat circuit device from the holding is not required to be kept above the housing mounted on the solid circuit board.

According to the present invention, as claimed in any one of claims, there is provided an electrical connector, which comprises a housing made of insulator to be mounted on a solid circuit board and provided thereon with an opening through which a flat circuit device, such as an FPC or an FFC, is inserted into the housing, a plurality of conductive contacts arranged on the housing to be electrically connected respectively with circuit terminals provided on the solid circuit board and positioned to correspond respectively to connecting terminals provided on the flat circuit device when the flat circuit device is inserted in the housing through the opening provided thereon, a conductive shell mounted on the housing to cover partially the same and to be electrically connected with a grounded portion provided on the solid circuit board and provided with a holding member formed in a body thereon to extend into the housing for engaging with the flat circuit device inserted in the housing to hold the same, and a releasing member provided in a body on the housing to be movable with a manipulatable portion projecting from the inside to the outside of the housing at a portion of the housing neighboring the opening through which the flat circuit device is inserted into the housing and a pressing portion projecting from the manipulatable portion to engage with the holding member, wherein the manipulatable portion of the releasing member is formed to be movable in a direction along which the conductive contacts are arranged and the pressing portion of the releasing member is operative to move for pressing the holding member so as to cause the same to disengage from the flat circuit device inserted in the housing so that the flat circuit device is released from holding by the holding member when the manipulatable portion of the releasing member is moved in the direction along which the conductive contacts are arranged under a condition wherein the holding member is put in engagement with the flat circuit device inserted into the housing to hold the same.

Especially, in a first example of electronic connector according to the present invention, such as claimed in claim 2, the holding member is provided with an engaging portion for engaging with an engaging edged portion provided on the flat circuit device inserted in the housing to hold the flat circuit device in the housing, a resilient arm portion for supporting the engaging portion to be shiftable in position and a press-receiving portion projecting from the resilient arm portion to form thereon a slanted surface inclined to the direction along which the conductive contacts are arranged, and the pressing portion of the releasing member engages with the slanted surface formed on the press-receiving portion of the holding member.

Further, in a second example of electronic connector according to the present invention, such as claimed in claim 8, the conductive shell is provided, in addition to the holding member, with a resilient engaging portion extending into the inside of the conductive shell for engaging with the manipulatable portion of the releasing member so as to apply on the manipulatable portion a resilient force contributing to a returning movement of the manipulatable portion when the manipulatable portion of the releasing member is moved in the direction along which the conductive contacts are arranged.

In the electrical connector thus constituted in accordance with the present invention, when the housing is mounted on the solid circuit board and the flat circuit device is inserted into the housing thorough the opening provided thereon, each of the conductive contacts provided to be arranged in the housing comes into press-contact with a corresponding one of the connecting terminals provided on the flat circuit device inserted in the housing and the holding member formed in the conductive shell engages with the flat circuit device inserted in the housing to hold the same. As a result, the flat circuit device inserted in the housing is prevented from getting out of the housing unwillingly.

Then, when the manipulatable portion of the releasing member provided in a body on the housing, which projects from the inside to the outside of the housing at the portion of the housing neighboring the opening through which the flat circuit device is inserted into the housing, is moved in the direction along which the conductive contacts are arranged under the condition wherein the holding member is put in engagement with the flat circuit device inserted into the housing to hold the same, the pressing portion projecting from the end of the manipulatable portion is operative to move for pressing the holding member so as to cause the same to disengage from the flat circuit device inserted in the housing so that the flat circuit device is released from the holding by the holding member. As a result, the flat circuit device inserted in the housing is put in the condition to be able to get out of the housing.

The holding member employed, for example, in the first example of electrical connector as mentioned above has the engaging portion for engaging with the engaging edged portion provided on the flat circuit device inserted in the housing to hold the flat circuit device in the housing, the resilient arm portion for supporting the engaging portion to be shiftable in position and the press-receiving portion projecting from the resilient arm portion to form thereon the slanted surface inclined to the direction along which the conductive contacts are arranged. The pressing portion of the releasing member engages with the slanted surface formed on the press-receiving portion of the holding member.

In the first example of electrical connector employing the holding member thus constituted, when the manipulatable portion of the releasing member is moved in the direction along which the conductive contacts are arranged under a condition wherein the engaging portion of the holding member is put in engagement with the engaging edged portion provided on the flat circuit device inserted in the housing, the pressing portion of the releasing member is operative to move in the direction along which the conductive contacts are arranged for pressing the slanted surface formed on the press-receiving portion of the holding member so as to cause the holding member to move in a direction perpendicular to the direction along which the conductive contacts are arranged so that the engaging portion of the holding member is shifted in its position in the direction perpendicular to the direction along which the conductive contacts are arranged. As a result, the engaging portion of the holding member disengages from the engaging edged portion provided on the flat circuit device inserted in the housing.

Further, the conductive shell provided for covering partially the housing and employed, for example, in the second example of electrical connector as mentioned above has, in addition to the holding member, the resilient engaging portion which extends into the inside of the conductive shell for engaging with the manipulatable portion of the releasing member. The resilient engaging portion of the conductive shell is operative to apply on the manipulatable portion of the releasing member the resilient force contributing to the returning movement of the manipulatable portion when the manipulatable portion is moved in the direction along which the conductive contacts are arranged.

With the electrical connector constituted in accordance with the present invention as described above, it is not required, for causing the holding member formed in a body in the conductive shell to be put in engagement with the flat circuit device inserted in the housing to hold the same and then to be released by the releasing member provided in a body on the housing from the engagement with the flat circuit device to put the same in free, to provide on the housing an actuator rotatable in regard to the housing or to set the conductive shell to be rotatable in regard to the housing. Accordingly, the conductive shell fixed to the housing can be used for fastening the housing to the solid circuit board and any additional member for fastening the housing to the solid circuit board is not required. As a result, the electrical connector according to the present invention can be constituted with a relatively small number of constitutive parts and at a production cost reduced effectively.

In the electrical connector according to the present invention, the holding member is automatically put in engagement with the flat circuit device to hold the same in the housing when the flat circuit device is inserted into the housing through the opening provided thereon and then the holding member is released from the engagement with the flat circuit device inserted in the housing when the manipulatable portion of the releasing member, which projects from the inside to the outside of the housing at the portion of the housing neighboring the opening through which the flat circuit device is inserted into the housing, is moved in the direction along which the conductive contacts are arranged. Therefore, the holding member can be released from the engagement with the flat circuit device inserted in the housing by an extremely simple and easy manipulation.

Since the manipulatable portion of the releasing member is provided to project from the inside to the outside of the housing at the portion of the housing neighboring the opening through which the flat circuit device is inserted into the housing and not to project upward from the housing toward the outside of the conductive shell covering partially the housing on the side of an upper surface of the housing opposite to a lower surface of the housing facing the solid circuit board, the manipulatable portion of the releasing member has no effect on a measure of thickness of the housing in a direction perpendicular to the solid circuit board on which the housing is mounted. Consequently, with the electrical connector according to the present invention, the measure of thickness of the housing can be reduced sufficiently to obtain a thin circuit board assembly.

Further, with the electrical connector according to the present invention, since the holding member is released from the engagement with the flat circuit device inserted in the housing when the manipulatable portion of the releasing member is moved in the direction along which the conductive contacts are arranged and which is perpendicular to a direction from the upper surface to the lower surface of the housing, the flat circuit device inserted in the housing can be surely put in holding by the holding member to be prevented from getting out of the housing unwillingly and then released from the holding by the holding member so as to be able to get out of the housing under a condition wherein an open space enough to conduct the manipulation for releasing the flat circuit device from the holding by the holding member is not required to be kept above the housing covered partially by the conductive shell on the solid circuit board.

Especially, in the first example of electrical connector according to the present invention, since the holding member has the engaging portion for engaging with the engaging edged portion provided on the flat circuit device inserted in the housing to hold the flat circuit device in the housing, the resilient arm portion for supporting the engaging portion to be shiftable in position and the press-receiving portion projecting from the resilient arm portion to form thereon the slanted surface inclined to the direction along which the conductive contacts are arranged, and the pressing portion of the releasing member engages with the slanted surface formed on the press-receiving portion of the holding member, the flat circuit board inserted in the housing can be much more surely put in holding by the holding member and then released from the holding by the holding member.

Besides, in the second example of electrical connector according to the present invention, since the conductive shell provided for covering partially the housing has, in addition to the holding member, the resilient engaging portion which extends into the inside of the conductive shell for engaging with the manipulatable portion of the releasing member so as to apply on the manipulatable portion the resilient force contributing to the returning movement of the manipulatable portion when the manipulatable portion of the releasing member is moved in the direction along which the conductive contacts are arranged, the manipulatable portion of the releasing member having moved in the direction along which the conductive contacts are arranged can return rapidly and surely to an original position with the resilient force from the resilient engaging portion of the conductive shell.

The above, and other objects, features and advantages of the present invention will become apparent from the following detailed description taken in conjunction with the accompanying drawings.

DETAILED DESCRIPTION OF THE INVENTION

Figure 1:
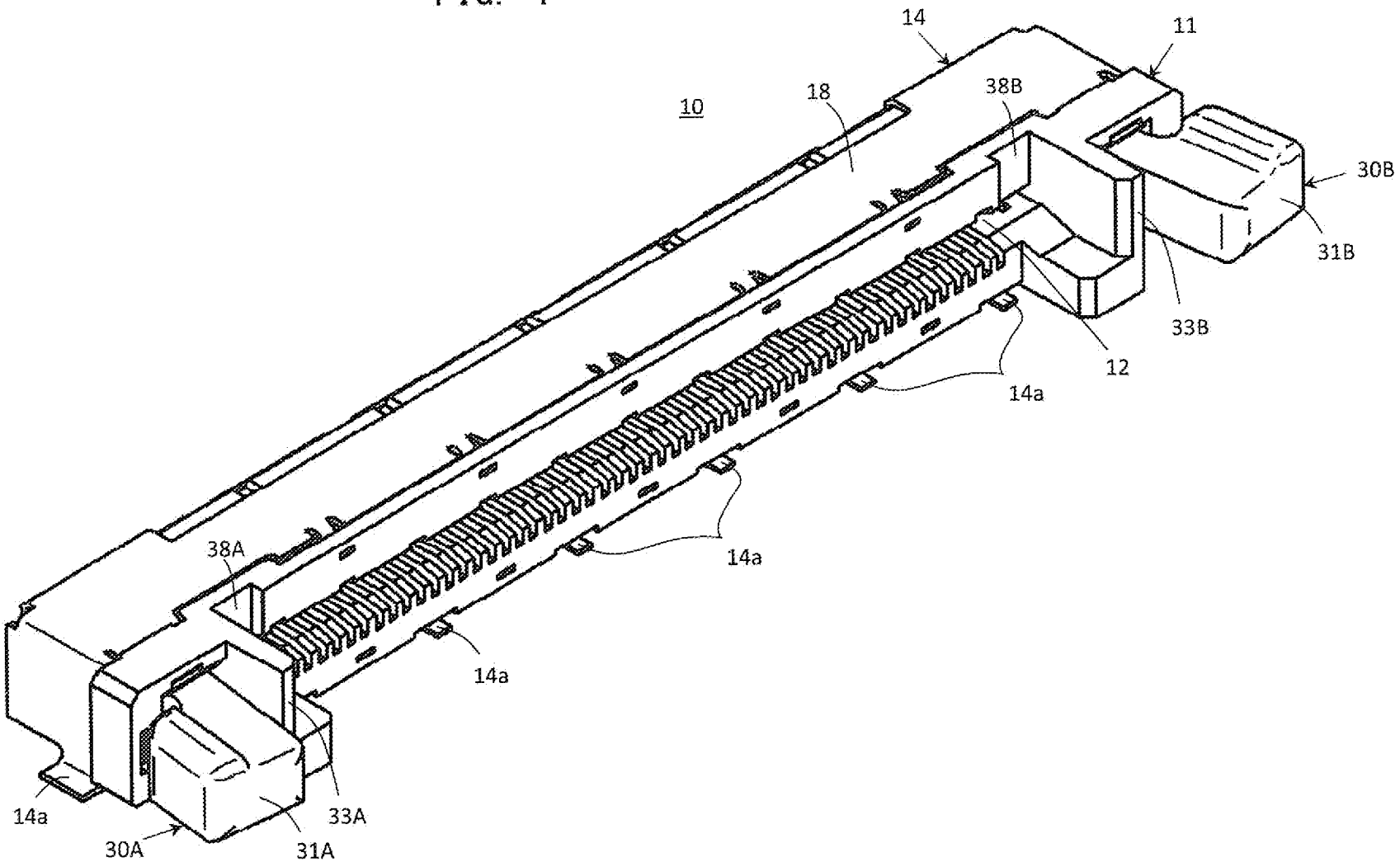
FIG. 1 is a schematic front, top and left side perspective view showing a first embodiment of electrical connector according to the present invention.
Figure 2:
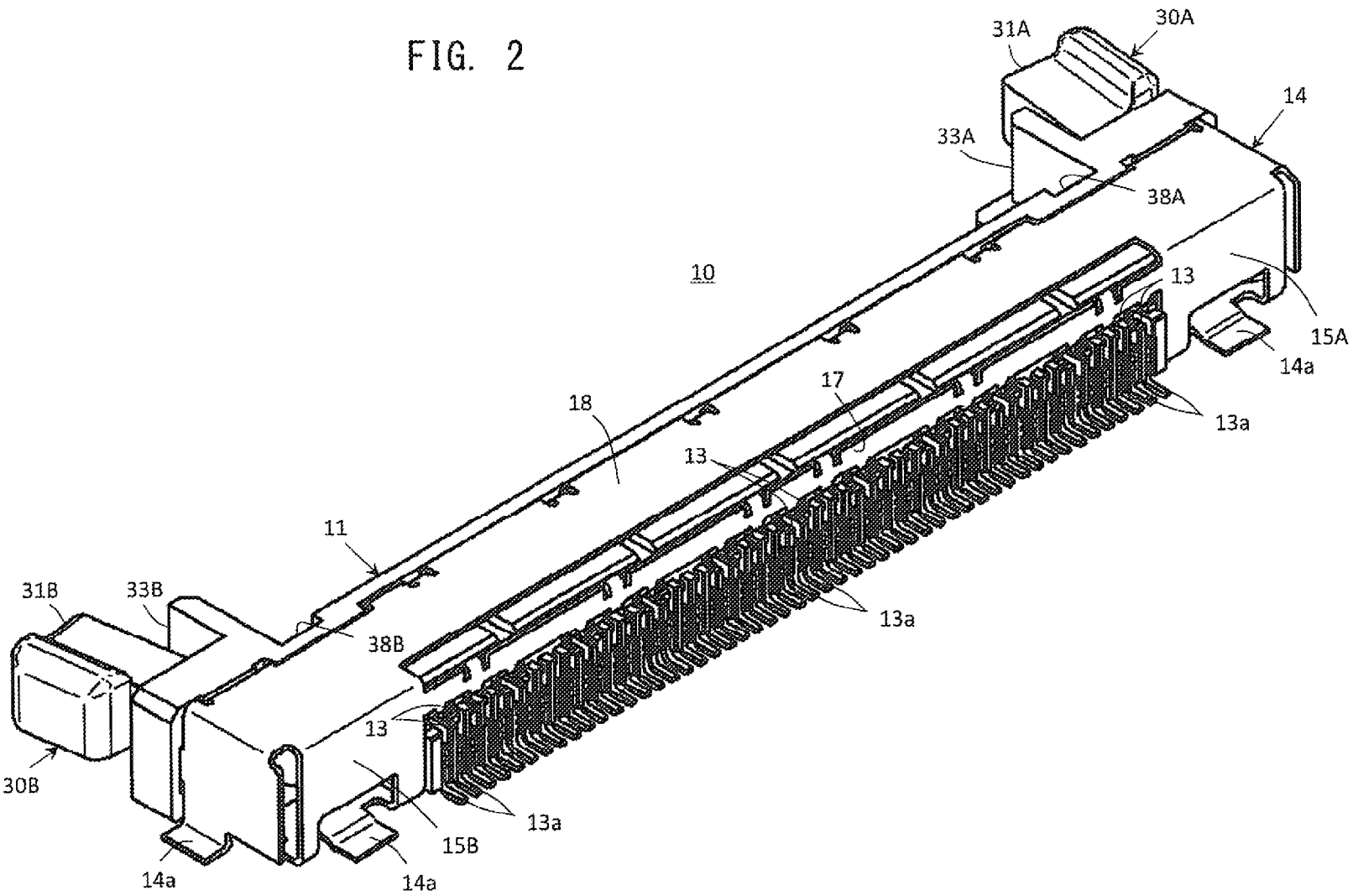
FIG. 2 is a schematic rear, top and right side perspective view showing the first embodiment shown in FIG. 1.
Figure 3:
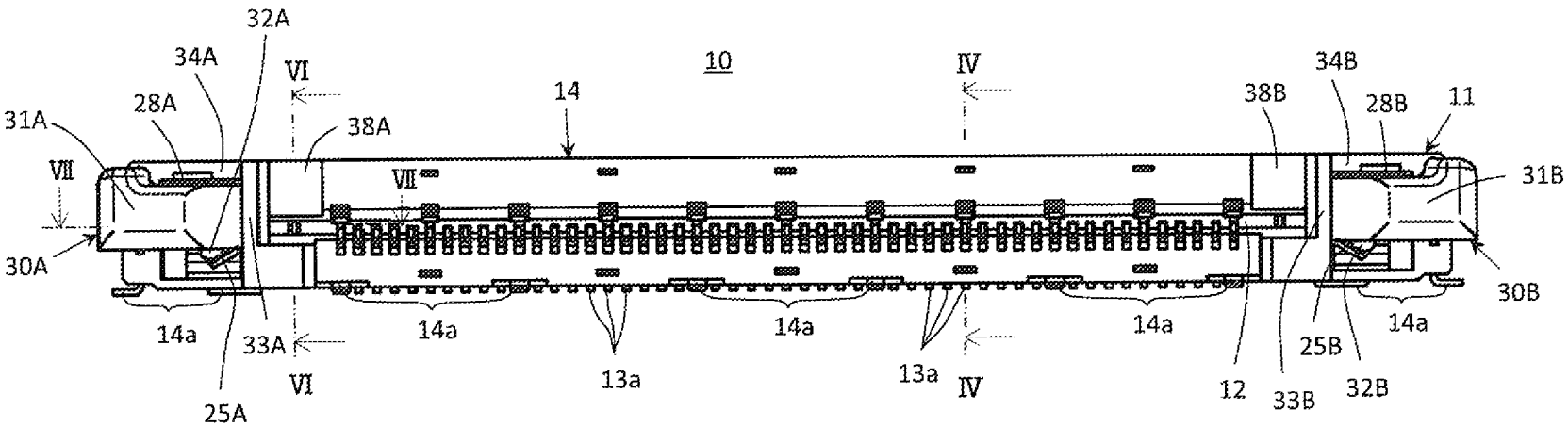
FIG. 3 is a schematic front view showing the first embodiment shown in FIG. 1.

Each of FIG. 1 which is a schematic front, top and left side perspective view, FIG. 2 which is a schematic rear, top and right side perspective view and FIG. 3 which is a schematic front view, shows a first embodiment of electrical connector according to the present invention.

Referring to FIGS. 1 to 3, an electrical connector 10, which constitutes the first embodiment of electrical connector according to the present invention, has a housing 11 made of insulator, such as plastics or the like. The housing 11 is provided on a front end portion thereof with an opening 12 through which a flat circuit device, such as an FPC, is inserted into the housing 11 and further provided with a room extending from the opening 12 into the inside of the housing 11 for accommodating the flat circuit device inserted in the housing 11. The front end portion of the housing 11 is constituted with a part of the housing 11 forming the opening 12 and a part of the housing 11 surrounding the part of the housing 11 forming the opening 12.

When the electrical connector 10 is put in practical use for mounting, for example, the FPC which constitutes the flat circuit device, on a solid circuit board in an electronic apparatus (not shown in the drawings), the housing 11 is mounted on the solid circuit board so that the electrical connector 10 is fixed in its entirety to the solid circuit board. The housing 11 mounted on the solid circuit board has an upper surface which is an outer surface of an upper end portion of the housing 11 and open to a space on the solid circuit board and a lower surface which is an outer surface of a lower end portion of the housing 11 and opposite to the upper surface to face the solid circuit board.

A plurality of conductive contacts 13, each of which is made of resilient conductive material, are provided on the housing 11 to be arranged in a longitudinal direction of the housing 11 extending along a surface of the solid circuit board on which the housing 11 is mounted. The conductive contacts 13 are operative to be electrically connected respectively with connecting terminals provided on the FPC inserted in the housing 11. To be more concrete, each of the conductive contacts 13 constitutes one of a signal contact, a ground contact and a power supply contact which are electrically connected respectively with a signal connecting terminal, a ground connecting terminal and a power source connecting terminal provide on the FPC inserted in the housing 11.

Further, each of the conductive contact 13 has a connecting terminal portion 13*a* projecting from a rear end portion of the housing 11 to the outside thereof, as shown in FIG. 2. The connecting terminal portion 13*a* of the conductive contact 13 is connected electrically with one of circuit terminals provided on the solid circuit board on which the housing 11 is mounted. These conductive contacts 13 are, for example, thrust into the housing 11 from the rear end portion thereof shown in FIG. 2 when the electrical connector 10 is assembled.

When the FPC is inserted into the housing 11 through the opening 12 provided thereon, the conductive contacts 13 come into press-contact with the connecting terminals provided on the FPC inserted in the housing 11, respectively. Therefore, the connecting terminals provided on the FPC inserted in the housing 11 are electrically connected through the conductive contacts 13 with the circuit terminals provided on the solid circuit board on which the housing 11 is mounted.

The electrical connector 10 has also a conductive shell 14 mounted on the housing 11 for covering a major part of the housing 11 except the front end portion of the housing 11 on which the opening 12 is provided. To be more concrete, the conductive shell 14 covers a large part of the upper end portion of the housing 11, a large part of each of left and right side end portions of the housing 11, a part of the lower end portion of the housing 11 and a part of the rear end portion of the housing 11.

The conductive shell 14 is formed by means of processing a metal thin plate and grounded to be operative mainly to shield the conductive contacts 13 provided on the housing 11 from electromagnetic wave noises coming from the outside.

As shown in FIG. 2, the conductive shell 14 does not cover the front end portion of the housing 11, portions surrounding the front end portion of the housing 11, a part of a portion between the upper end portion and the rear end portion of the housing 11 and a central part of the rear end portion of the housing 11, from which the connecting terminal portion 13*a* of each of the conductive contacts 13 extends to the outside of the housing 11. Further, the conductive shell 14 is provided with a plurality of ground connecting portions 14*a*, each of which is operative to be connected electrically by, for example, soldering with grounded portions provided on the solid circuit board on which the housing 11 is mounted.

Since the conductive shell 14 covers the major part of the upper end portion of the housing 11, the left side end portion of the housing 11 and the right side end portion of the housing 11 and each of the ground connecting portions 14*a* provided on the conductive shell 14 is connected electrically by, for example, soldering with the grounded portion provided on the solid circuit board on which the housing 11 is mounted, as described above, the conductive contacts 13 provided on the housing 11 are sufficiently shielded by the conductive shell 14 from the electromagnetic wave noises coming from the outside. In addition, the conductive shell 14 is able to be used for fastening the housing 11 to the solid circuit board on which the housing 11 is mounted.

Figure 4:
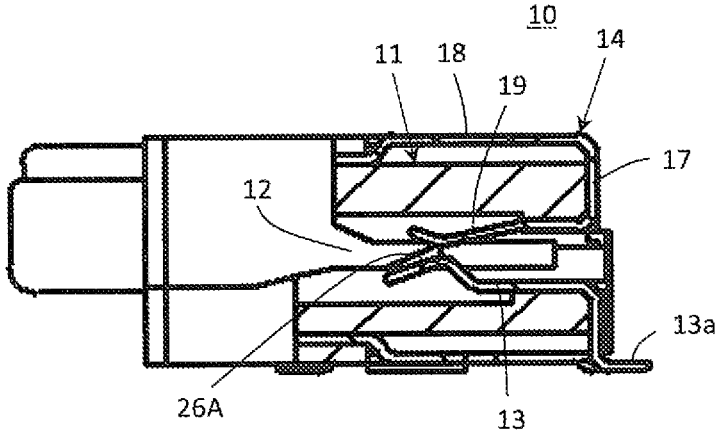
FIG. 4 is a schematic cross sectional view taken along line IV-IV on FIG. 3.

Further, the conductive shell 14 is provided with a belt-shaped plate portion 17 separated from an upper plate portion 18 of the conductive shell 14 covering the upper end portion of the housing 11 for connecting a pair of left and right rear plate portions 15A and 15B of the conductive shell 14 with each other on the rear end portion of the housing 11. The left rear plate portion 15A of the conductive shell 14 covers a left end part of the rear end portion of the housing 11 and the right rear plate portion 15B of the conductive shell 14 covers a right end part of the rear end portion of the housing 11. The belt-shaped plate portion 17 is provided thereon with a plurality of ground contacts 19. Each of the ground contacts 19 extends into the housing 11 toward the opening 12 formed in the front end portion of the housing 11 from the belt-shaped plate portion 17, as shown in FIG. 4 showing a cross sectional view taken along line IV-IV on FIG. 3. In the housing 11, the ground contacts 19 is positioned to be opposite to a corresponding one of the conductive contacts 13 and operative to come into press-contact with a ground connecting portion provided on the FPC when the FPC is inserted in the housing 11 through the opening 12 provided thereon.

Figure 5:
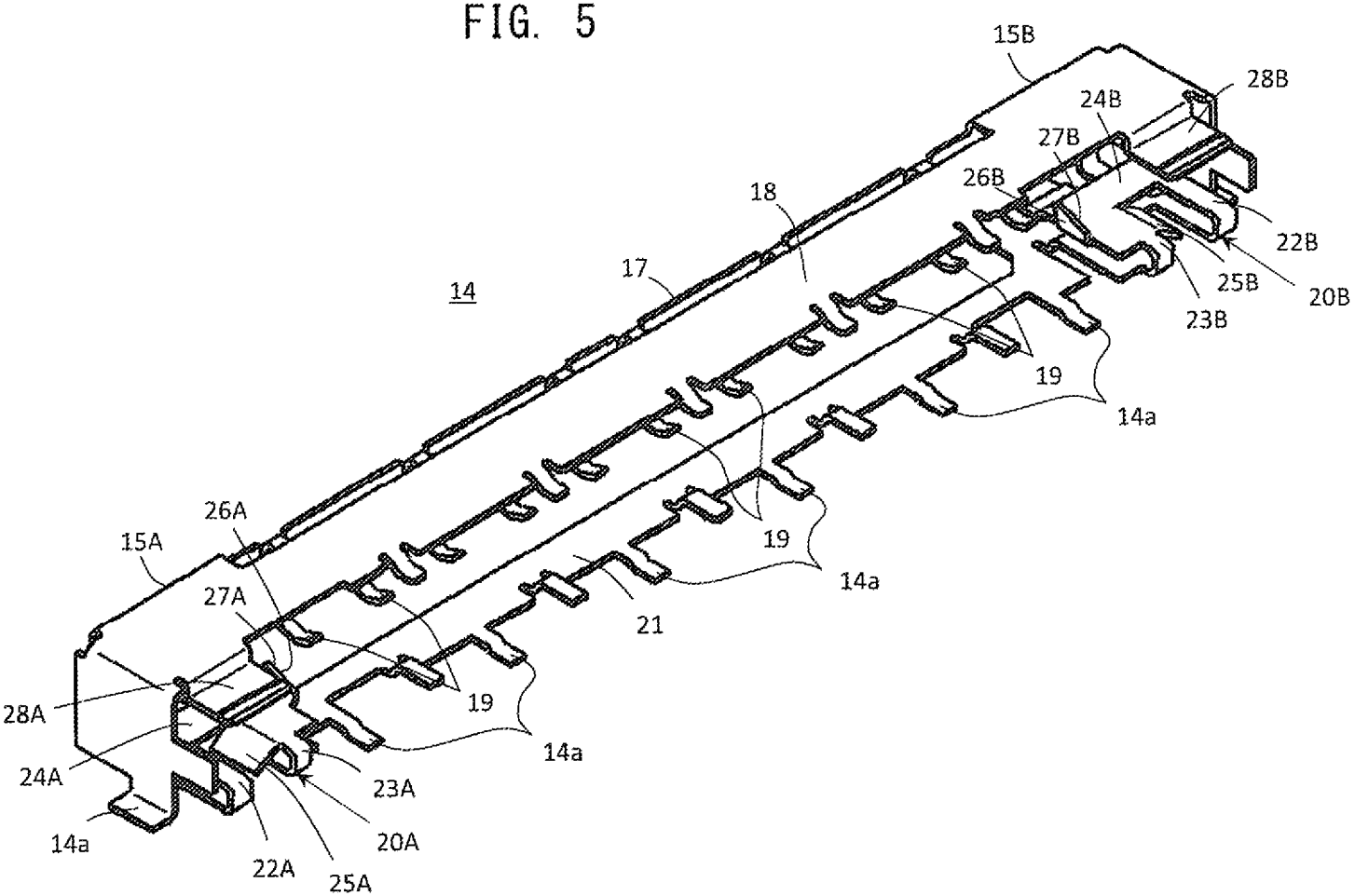
FIG. 5 is a schematic perspective view showing a conductive shell employed in the first embodiment shown in FIG. 1.

As shown in FIG. 5, the conductive shell 14 is also provided with a couple of holding members 20A and 20B for holding the FPC inserted in the housing 11 through the opening 12 provided thereon. The holding member 20A is formed in a body in the conductive shell 14 at a position opposite to the left rear plate portion 15A of the conductive shell 14 and the holding member 20B is also formed in a body in the conductive shell 14 at a position opposite to the right rear plate portion 15B of the conductive shell 14.

The holding member 20A is provided with a pair of folding portions 22A and 23A, each of which extends first from a left end of a lower plate portion 21 of the conductive shell 14 covering the lower end portion of the housing 11 toward the front end portion of the housing 11 and then folds back to extend toward the left rear plate portion 15A of the conductive shell 14, a connecting portion 24A for connecting the folding portions 22A and 23A with each other, a press-receiving portion 25A projecting from the folding portion 23A, and an engaging portion 26A provided on the folding portion 23A. In the holding member 20A thus constituted, the folding portions 22A and 23A and the connecting portion 24A in the aggregate constitute a resilient arm portion which is operative to shift in position resiliently in a direction passing through both of the upper and lower surfaces of the housing 11, so that the resilient arm portion is operative to support the engaging portion 26A to be shiftable in position in the direction passing through both of the upper and lower surfaces of the housing 11 and the press-receiving portion 25A projects from the resilient arm portion.

Each of the folding portions 22A and 23A is shaped into a resilient strip with a predetermined width. The width of the resilient strip forming the folding portion 22A is selected to be equal to or larger than the width of the resilient strip forming the folding portion 23A. The press-receiving portion 25A forms thereon a slanted surface inclined to the longitudinal direction of the housing 11, that is, the direction along which the conductive contacts 13 are arranged. Further, the engaging portion 26A constitutes a projection standing up on the folding portion 23A forming the resilient arm portion toward the upper plate portion 18 of the conductive shell 14 and is operative to shift in position with the shift of the resilient arm portion in the direction passing through both of the upper and lower surfaces of the housing 11.

Similarly, the holding member 20B is provided with a pair of folding portions 22B and 23B, each of which extends first from a right end of the lower plate portion 21 of the conductive shell 14 toward the front end portion of the housing 11 and then folds back to extend toward the right rear plate portion 15B of the conductive shell 14, a connecting portion 24B for connecting the folding portions 22B and 23B with each other, a press-receiving portion 25B projecting from the folding portion 23B, and an engaging portion 26B provided on the folding portion 23B. In the holding member 20B thus constituted, the folding portions 22B and 23B and the connecting portion 24B in the aggregate constitute a resilient arm portion which is operative to shift in position resiliently in the direction passing through both of the upper and lower surfaces of the housing 11, so that the resilient arm portion is operative to support the engaging portion 26B to be shiftable in position in the direction passing through both of the upper and lower surfaces of the housing 11 and the press-receiving portion 25B projects from the resilient arm portion.

Each of the folding portions 22B and 23B is shaped into a resilient strip with a predetermined width. The width of the resilient strip forming the folding portion 22B is selected to be equal to or larger than the width of the resilient strip forming the folding portion 23B. The press-receiving portion 25B forms thereon a slanted surface inclined to the longitudinal direction of the housing 11 along which the conductive contacts 13 are arranged. Further, the engaging portion 26B constitutes a projection standing up on the folding portion 23B forming the resilient arm portion toward the upper plate portion 18 of the conductive shell 14 and is operative to shift in position with the shift of the resilient arm portion in the direction passing through both of the upper and lower surfaces of the housing 11.

Figure 6:
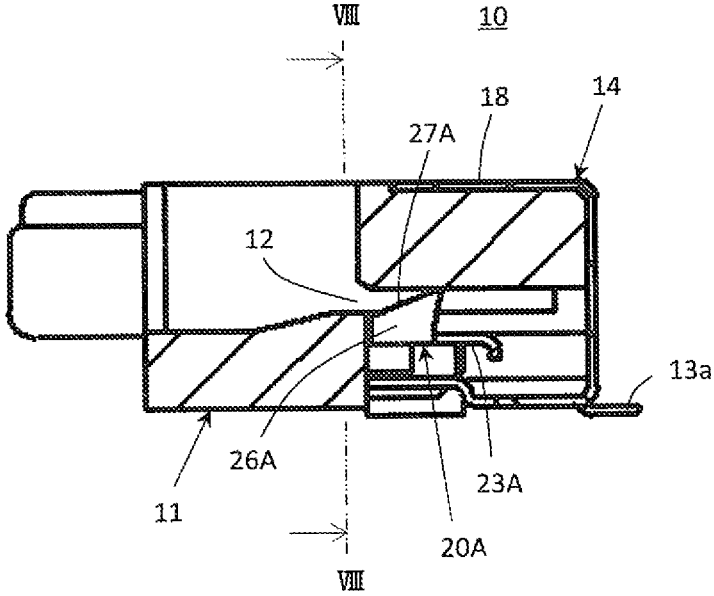
FIG. 6 is a schematic cross sectional view taken along line VI-VI on FIG. 3.

As shown in FIG. 6 showing a cross sectional view taken along line VI-VI on FIG. 3, the engaging portion 26A of the holding member 20A, which constitutes the projection standing up on the folding portion 23A forming the resilient arm portion toward the upper plate portion 18 of the conductive shell 14, has an upper end part forming thereon a slanted end plane 27A ascending gradually in a direction along which the FPC is inserted into the housing 11 through the opening 12 provided thereon. The upper end part of the engaging portion 26A forming thereon the slanted end plane 27A is positioned in the inside of the conductive shell 14 for engaging with an engaging edged recess provided on the FPC inserted in the housing 11, as described later.

Similarly, the engaging portion 26B of the holding member 20B, which constitutes the projection standing up on the folding portion 23B forming the resilient arm portion toward the upper plate portion 18 of the conductive shell 14, has an upper end part forming thereon a slanted end plane 27B ascending gradually in the direction along which the FPC is inserted into the housing 11 through the opening 12 provided thereon. The upper end part of the engaging portion 26B forming thereon the slanted end plane 27B is positioned in the inside of the conductive shell 14 for engaging with an engaging edged recess provided on the FPC inserted in the housing 11, as described later.

Further, the conductive shell 14 is provide on a left front end portion opposite to the left rear plate portion 15A thereof with a left plate-like engaging portion 28A which extends from a left end of the upper plate portion 18 of the conductive shell 14 toward the outside of the conductive shell 14 for engaging with a left end portion of the housing 11 which neighbors the opening 12 provided on the front end portion of the housing 11 and provided also on a right front end portion opposite to the right rear plate portion 15B thereof with a right plate-like engaging portion 28B which extends from a right end of the upper plate portion 18 of the conductive shell 14 toward the outside of the conductive shell 14 for engaging with a right end portion of the housing 11 which neighbors the opening 12 provided on the front end portion of the housing 11.

The housing 11 is provided on the left and right end portions thereof with a couple of releasing members 30A and 30B to be manipulated for releasing the FPC inserted in the housing 11 from holding by the holding members 20A and 20B. The releasing member 30A is provided in a body on the housing 11 at a position corresponding to the holding member 20A and the releasing member 30B is also provided in a body on the housing 11 at a position corresponding to the holding member 20B.

Figure 7:
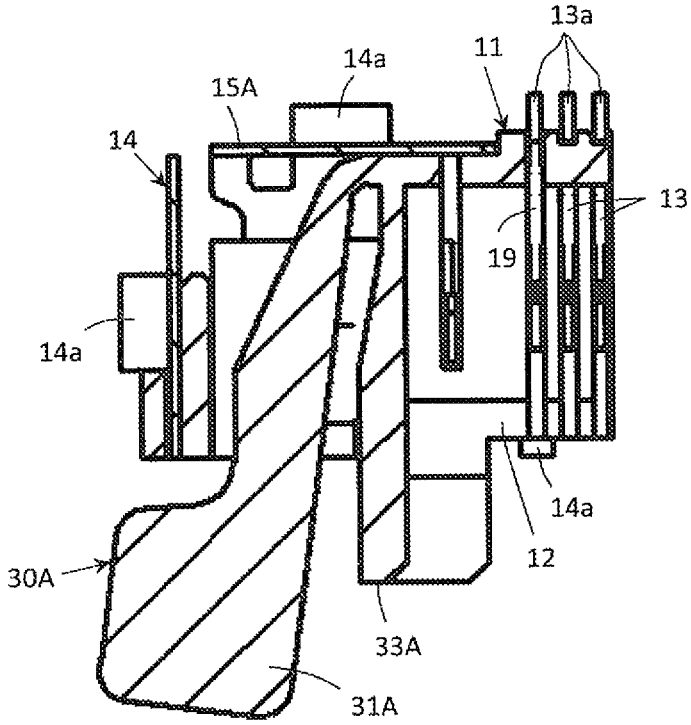
FIG. 7 is a schematic cross sectional view taken along line VII-VII on FIG. 3.
Figure 8:
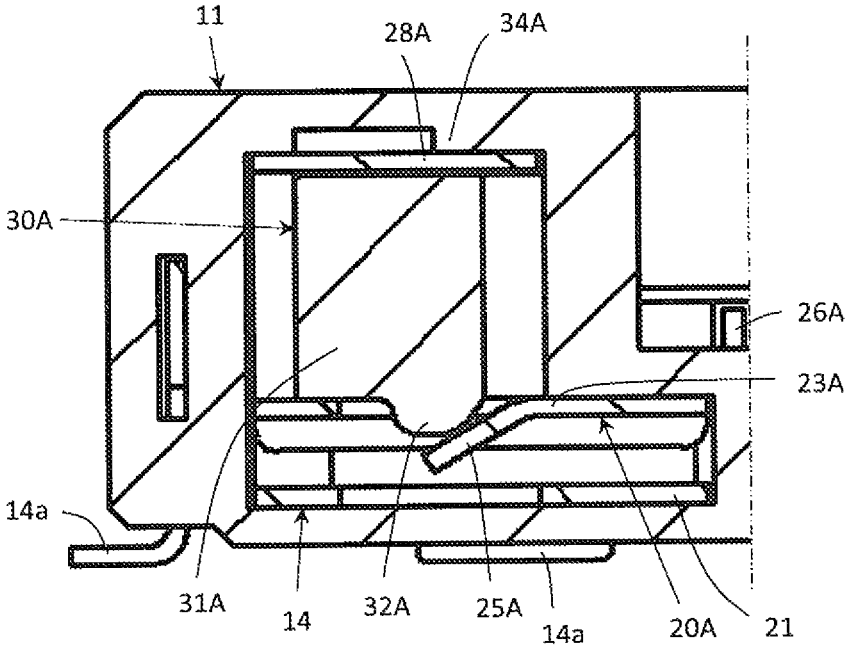
FIG. 8 is a schematic partial cross sectional view taken along line VIII-VIII on FIG. 6.
Figure 9:
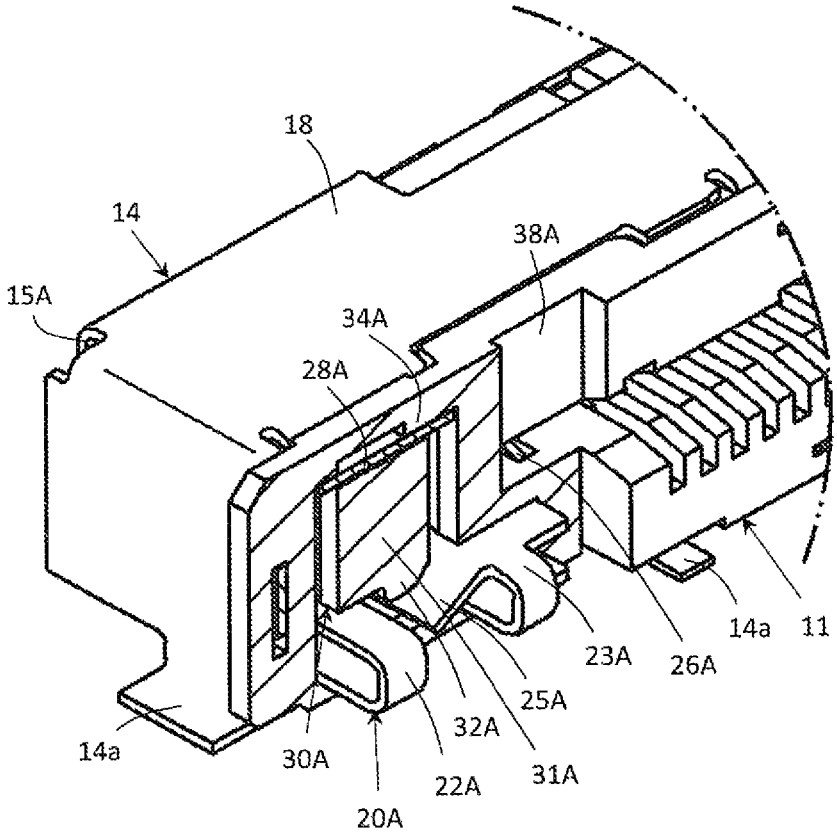
FIG. 9 is a schematic partial perspective view including a partial cross sectional view for showing an arrangement of a holding member and a releasing member employed in the first embodiment shown in FIG. 1.

As shown in FIG. 7 showing a cross sectional view taken along line VII-VII on FIG. 3, the releasing member 30A has a manipulatable portion 31A extending from the rear end portion of the housing 11 toward the outside of the front end portion of the housing 11 so as to project from the inside to the outside of the housing 11 at the left end portion of the housing 11 neighboring the opening 12 provided on the front end portion of the housing 11 and a pressing portion 32A projecting downward from a lower end of the manipulatable portion 31A, as shown in FIG. 8 showing a cross sectional view taken along line VIII-VIII on FIG. 6 and FIG. 9.

The manipulatable portion 31A of the releasing member 30A is provided to be resilient and movable in the longitudinal direction of the housing 11 along which the conductive contacts 13 are arranged. The pressing portion 32A of the releasing member 30A is provided to engage with the slanted surface formed on the press-receiving portion 25A of the holding member 20A. When the manipulatable portion 31A of the releasing member 30A is manipulated to move in the longitudinal direction of the housing 11 along which the conductive contacts 13 are arranged, the pressing portion 32A of the releasing member 30A is moved also in the longitudinal direction of the housing 11 along which the conductive contacts 13 are arranged, together with the manipulatable portion 31A.

Although detailed illustrations have been omitted, the releasing member 30B has a manipulatable portion 31B extending from the rear end portion of the housing 11 toward the outside of the front end portion of the housing 11 so as to project from the inside to the outside of the housing 11 at the right end portion of the housing 11 neighboring the opening 12 provided on the front end portion of the housing 11 and a pressing portion 32B projecting downward from a lower end of the manipulatable portion 31B as shown in FIG. 3.

The manipulatable portion 31B of the releasing member 30B is provided to be resilient and movable in the longitudinal direction of the housing 11 along which the conductive contacts 13 are arranged. The pressing portion 32B of the releasing member 30B is provided to engage with the slanted surface formed on the press-receiving portion 25B of the holding member 20B. When the manipulatable portion 31B of the releasing member 30B is manipulated to move in the longitudinal direction of the housing 11 along which the conductive contacts 13 are arranged, the pressing portion 32B of the releasing member 30B is moved also in the longitudinal direction of the housing 11 along which the conductive contacts 13 are arranged, together with the manipulatable portion 31B.

On the left end portion of the housing 11 neighboring the opening 12 provided on the front end portion of the housing 11, a movement-limiting portion 33A for limiting a movement of the manipulatable portion 31A of the releasing member 30A in the longitudinal direction of the housing 11 along which the conductive contacts 13 are arranged is provided to be in the vicinity of the manipulatable portion 31A of the releasing member 30A for projecting from the housing 11 toward the outside of the housing 11. Similarly, on the right end portion of the housing 11 neighboring the opening 12 provided on the front end portion of the housing 11, a movement-limiting portion 33B for limiting a movement of the manipulatable portion 31B of the releasing member 30B in the longitudinal direction of the housing 11 along which the conductive contacts 13 are arranged is also provided to be in the vicinity of the manipulatable portion 31B of the releasing member 30B for projecting from the housing 11 toward the outside of the housing 11.

Further, as shown clearly in FIGS. 3, 8 and 9, on the left end portion of the housing 11 neighboring the opening 12 provided on the front end portion of the housing 11, a shell-receiving portion 34A is provided to be positioned above the manipulatable portion 31A of the releasing member 30A for receiving the left plate-like engaging portion 28A provided on the left front end portion of the conductive shell 14. Similarly, on the right end portion of the housing 11 neighboring the opening 12 provided on the front end portion of the housing 11, a shell-receiving portion 34B is also provided to be positioned above the manipulatable portion 31B of the releasing member 30B for receiving the right plate-like engaging portion 28B provided on the right front end portion of the conductive shell 14, as shown in FIG. 3.

Besides, a couple of vertical grooves 38A and 38B are provided on the front end portion of the housing 11 in addition to the opening 12. Each of the vertical grooves 38A and 38B is used for observing therethrough a condition wherein the FPC inserted in the housing 11 through the opening 12 provided thereon has reached a predetermined destination in the housing 11.

Figure 10:
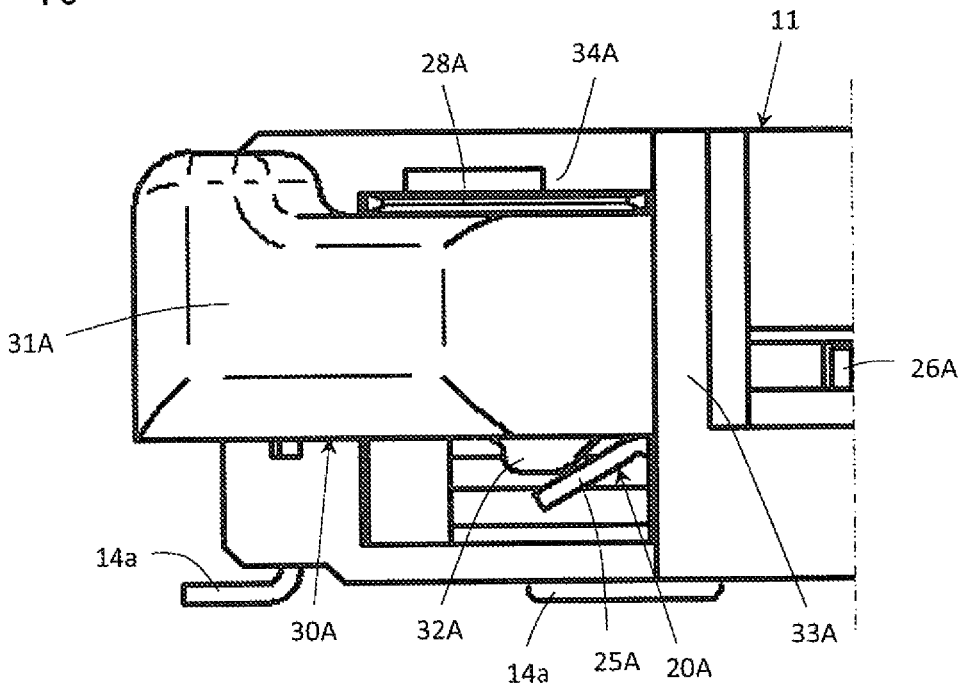
FIG. 10 is a schematic partial front view showing the arrangement of the holding member and the releasing member employed in the first embodiment shown in FIG. 1.

The manipulatable portion 31A of the releasing member 30A provided on the housing 11 takes up such a station as shown in FIG. 10 when any manipulation does not act on the manipulatable portion 31A. On that occasion, the pressing portion 32A of the releasing member 30A is positioned on the press-receiving portion 25A of the holding member 20A to be in contact with the slanted surface formed on the press-receiving portion 25A.

Figure 11:
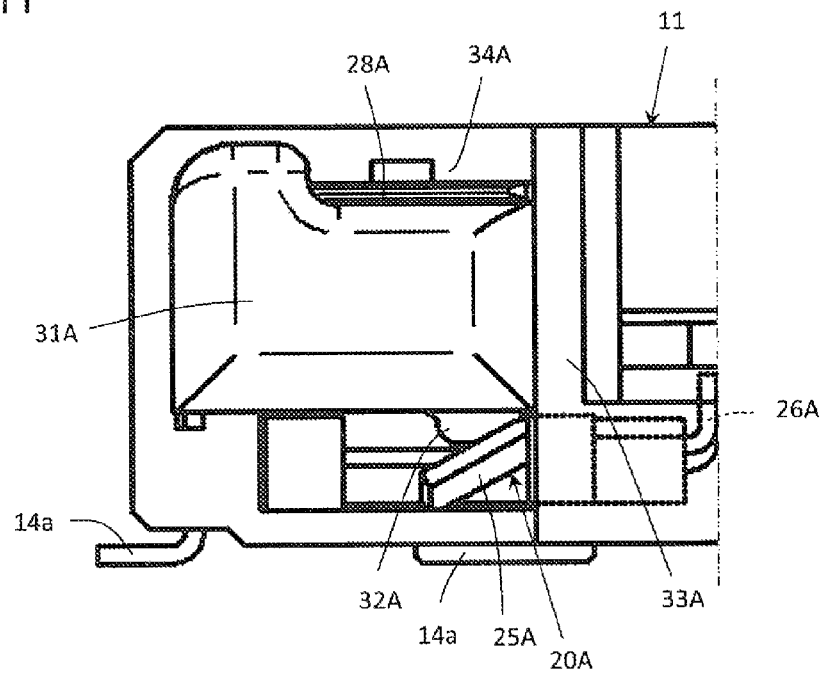
FIG. 11 is a schematic partial front view showing the arrangement of the holding member and the releasing member employed in the first embodiment shown in FIG. 1.

When the manipulatable portion 31A of the releasing member 30A is manipulated to move from the station shown in FIG. 10 in the longitudinal direction of the housing 11 along which the conductive contacts 13 are arranged so as to approach the movement-limiting portion 33A, the manipulatable portion 31A comes to take up such a station as shown in FIG. 11, for example, for coming into contact with the movement-limiting portion 33A so that the movement of the manipulatable portion 31A is limited by the movement-limiting portion 33A. With such a movement of the manipulatable portion 31A of the releasing member 30A, the pressing portion 32A of the releasing member 30A is operative to move in the longitudinal direction of the housing 11 along which the conductive contacts 13 are arranged for pressing the slanted surface formed on the press-receiving portion 25A of the holding member 20A. Thereby, the press-receiving portion 25A of the holding member 20A causes the resilient arm portion of the holding member 20A to deform resiliently so as to shift in position downward in the direction perpendicular to the longitudinal direction of the housing 11 along which the conductive contacts 13 are arranged. With such a shift of the press-receiving portion 25A of the holding member 20A, the engaging portion 26A of the holding member 20A shifts in position also downward in the direction perpendicular to the longitudinal direction of the housing 11 along which the conductive contacts 13 are arranged. After that, when the manipulatable portion 31A of the releasing member 30A is released from the manipulation acted thereon, the manipulatable portion 31A is operative to return to the station shown in FIG. 10 from the station shown in FIG. 11 with its own resilience and resilience of the resilient arm portion of the holding member 20A. With such a returning movement of the manipulatable portion 31A of the releasing member 30A, the resilient arm portion of the holding member 20A is subjected to resilient restoring deformation and thereby each of the press-receiving portion 25A and the engaging portion 26A of the holding member 20A is shifted in position upward to return to a former position.

The manipulatable portion 31B of the releasing member 30B provided on the housing 11 takes up a station corresponding to the station of the manipulatable portion 31A of the releasing member 30A shown in FIG. 10 when any manipulation does not act on the manipulatable portion 31B. On that occasion, the pressing portion 32B of the releasing member 30B is positioned on the press-receiving portion 25B of the holding member 20B to be in contact with the slanted surface formed on the press-receiving portion 25B.

When the manipulatable portion 31B of the releasing member 30B is manipulated to move from the station corresponding to the station of the manipulatable portion 31A of the releasing member 30A shown in FIG. 10 in the longitudinal direction of the housing 11 along which the conductive contacts 13 are arranged so as to approach the movement-limiting portion 33B, the manipulatable portion 31B comes to take up a station corresponding to the station of the manipulatable portion 31A of the releasing member 30A shown in FIG. 11, for example, for coming into contact with the movement-limiting portion 33B so that the movement of the manipulatable portion 31B is limited by the movement-limiting portion 33B. With such a movement of the manipulatable portion 31B of the releasing member 30B, the pressing portion 32B of the releasing member 30B is operative to move in the longitudinal direction of the housing 11 along which the conductive contacts 13 are arranged for pressing the slanted surface formed on the press-receiving portion 25B of the holding member 20B. Thereby, the press-receiving portion 25B of the holding member 20B causes the resilient arm portion of the holding member 20B to deform resiliently so as to shift in position downward in the direction perpendicular to the longitudinal direction of the housing 11 along which the conductive contacts 13 are arranged. With such a shift of the press-receiving portion 25B of the holding member 20B, the engaging portion 26B of the holding member 20B shifts in position also downward in the direction perpendicular to the longitudinal direction of the housing 11 along which the conductive contacts 13 are arranged. After that, when the manipulatable portion 31B of the releasing member 30B is released from the manipulation acted thereon, the manipulatable portion 31B is operative to return to the station corresponding to the station of the manipulatable portion 31A of the releasing member 30A shown in FIG. 10 from the station corresponding to the station of the manipulatable portion 31A of the releasing member 30A shown in FIG. 11 with its own resilience and resilience of the resilient arm portion of the holding member 20B. With such a returning movement of the manipulatable portion 31B of the releasing member 30B, the resilient arm portion of the holding member 20B is subjected to resilient restoring deformation and thereby each of the press-receiving portion 25B and the engaging portion 26B of the holding member 20B is shifted in position upward to return to a former position.

As described above, the electrical connector 10 is provided at both end portions thereof in the longitudinal direction of each of the housing 11 and the conductive shell 14 respectively with a couple of holding members 20A and 20B and a couple of releasing members 30A and 30B.

Figure 12:
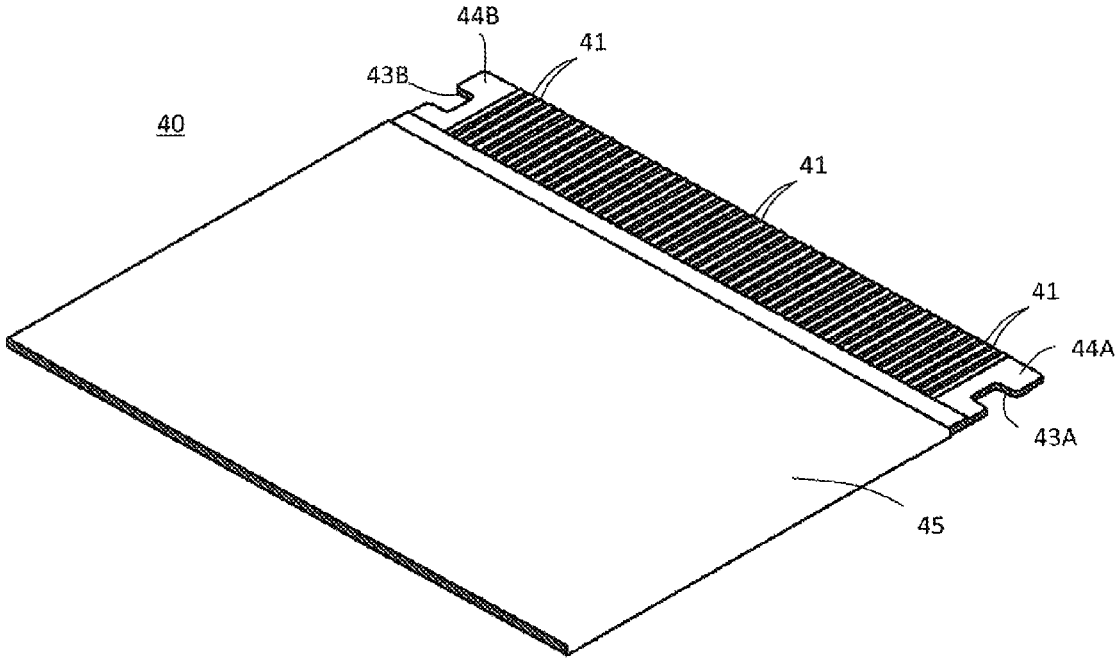
FIG. 12 is a schematic rear, top and right side perspective view showing an FPC which is to be inserted into a housing of the first embodiment shown in FIG. 1.

FIG. 12 shows an FPC 40 which is an example of the FPC constituting the flat circuit device to be inserted into the housing 11 of the electrical connector 10 through the opening 12 provided on the housing 11. In FIG. 12, a reverse surface of the FPC 40 facing upward is shown.

Referring to FIG. 12, a plurality of signal connecting terminals 41 each made of conductive material and formed into a rectangular strip are provided to be arranged on an end portion of the reverse surface of the FPC 40. Further, as shown in each of FIGS. 14 and 15, a ground connecting portion 42 is provided on an end portion of a front surface of the FPC 40, which opposite to the end portion of the reverse surface of the FPC 40, on which the signal connecting terminals 41 are arranged, with a body of the FPC 40 between.

In addition, a pair of engaging edged recesses 43A and 43B are provided respectively on left and right side end portions of the FPC 40 which are opposite to each other with the signal connecting terminals 41 on the reverse surface of the FPC 40 between. A top flat portion 44A is formed at the outside of the engaging edged recess 43A provided on the left side end portion of the FPC 40 and another top flat portion 44B is formed at the outside of the engaging edged recess 43B provided on the right side end portion of the FPC 40.

It is possible to provide the FPC 40 with a pair of engaging edged holes in place of the engaging edged recesses 43A and 43B. The FPC 40 is covered with a coating film 45 except portions thereof on which the signal connecting terminals 41, the ground connecting portion 42 and the engaging edged recesses 43A and 43B are provided and the top flat portions 44A and 44B.

Figure 13:
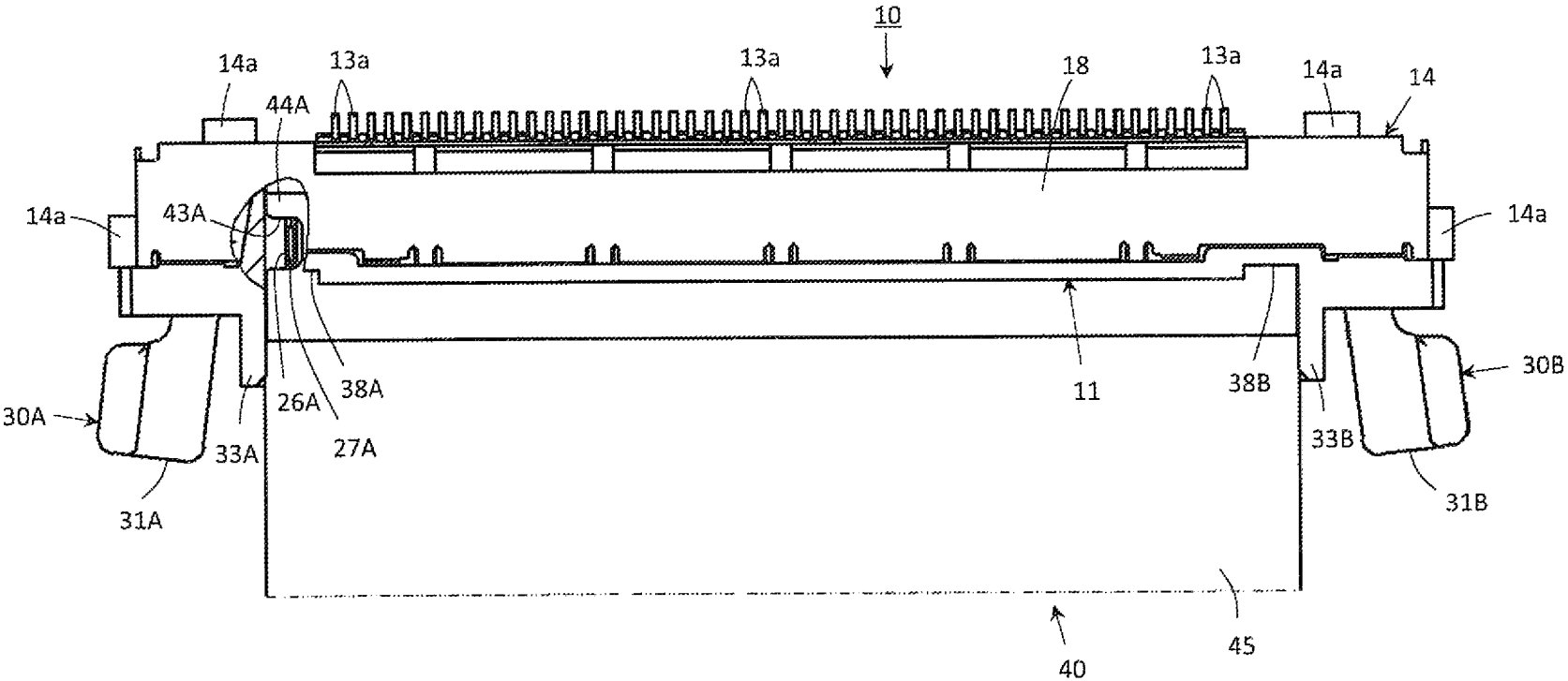
FIG. 13 is a schematic plan view including a partial cross sectional view for showing the first embodiment shown in FIG. 1 and the FPC which is positioned to be inserted into the housing of the first embodiment.

FIG. 13 shows the electrical connector 10 and the FPC 40 which is inserted in the housing 11 of the electrical connector 10 through the opening 12 provided on the housing 11. In FIG. 13, the front surface of the FPC 40, on which the ground connecting portion 42 is provided and which is covered with the coating film 45 and facing upward, is shown.

Under a condition wherein the FPC 40 is properly inserted in the housing 11 of the electrical connector 10 through the opening 12 provided on the housing 11, the upper end part of the engaging portion 26A of the holding member 20A, on which the slanted end plane 27A is formed, is put in engagement with the engaging edged recess 43A provided on the FPC 40, as shown in FIG. 13, and, although illustrations have been omitted, the upper end part of the engaging portion 26B of the holding member 20B, on which the slanted end plane 27B is formed, is put in engagement with the engaging edged recess 43B provided on the FPC 40. Thereby, the FPC 40 is held by the holding members 20A and 20B so as to be prevented from getting out of the housing 11 unwillingly.

Figure 14:
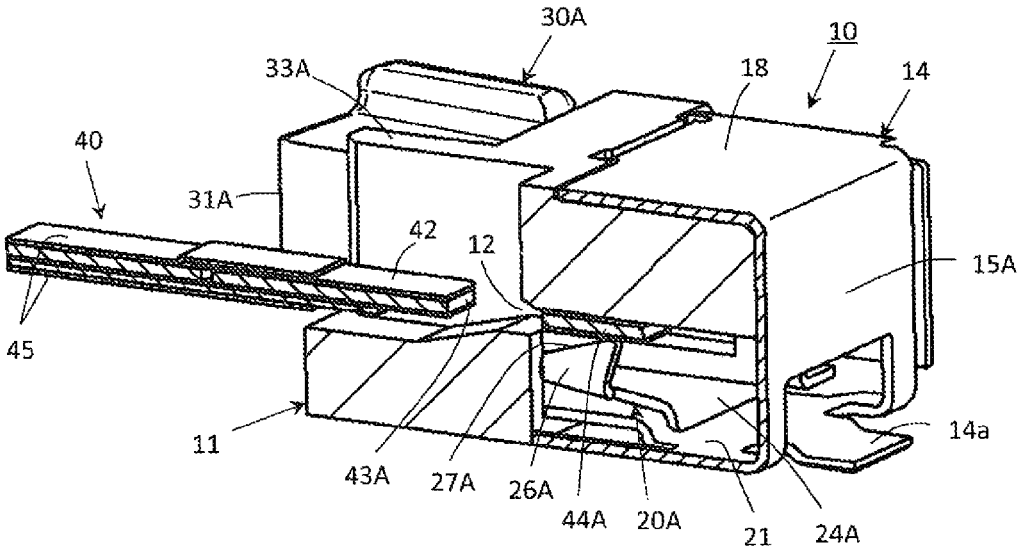
FIG. 14 is a schematic partial perspective view including a partial cross sectional view for showing the first embodiment shown in FIG. 1 and the FPC which is inserted in the housing of the first embodiment.

When the FPC 40 is inserted into the housing 11 of the electrical connector 10 through the opening 12 provided on the housing 11 to be put in the condition shown in FIG. 13, first the upper end part of the engaging portion 26A of the holding member 20A, on which the slanted end plane 27A is formed, comes into contact with the top flat portion 44A provided on the FPC 40 on the side of the lower plate portion 21 of the conductive shell 14 at the left end portion of the housing 11, as shown in FIG. 14. At this time, the engaging portion 26A of the holding member 20A is pushed toward the lower plate portion 21 of the conductive shell 14 by the top flat portion 44A provided on the FPC 40 and thereby the resilient arm portion of the holding member 20A is resiliently deformed so as to shift the engaging portion 26A of the holding member 20A in position to approach the lower plate portion 21 of the conductive shell 14.

In addition, although illustrations have been omitted, at the right end portion of the housing 11 also, the upper end part of the engaging portion 26B of the holding member 20B, on which the slanted end plane 27B is formed, comes into contact with the top flat portion 44B provided on the FPC 40 on the side of the lower plate portion 21 of the conductive shell 14. At this time, the engaging portion 26B of the holding member 20B is pushed toward the lower plate portion 21 of the conductive shell 14 by the top flat portion 44B provided on the FPC 40 and thereby the resilient arm portion of the holding member 20B is resiliently deformed so as to shift the engaging portion 26B of the holding member 20B in position to approach the lower plate portion 21 of the conductive shell 14.

Figure 15:
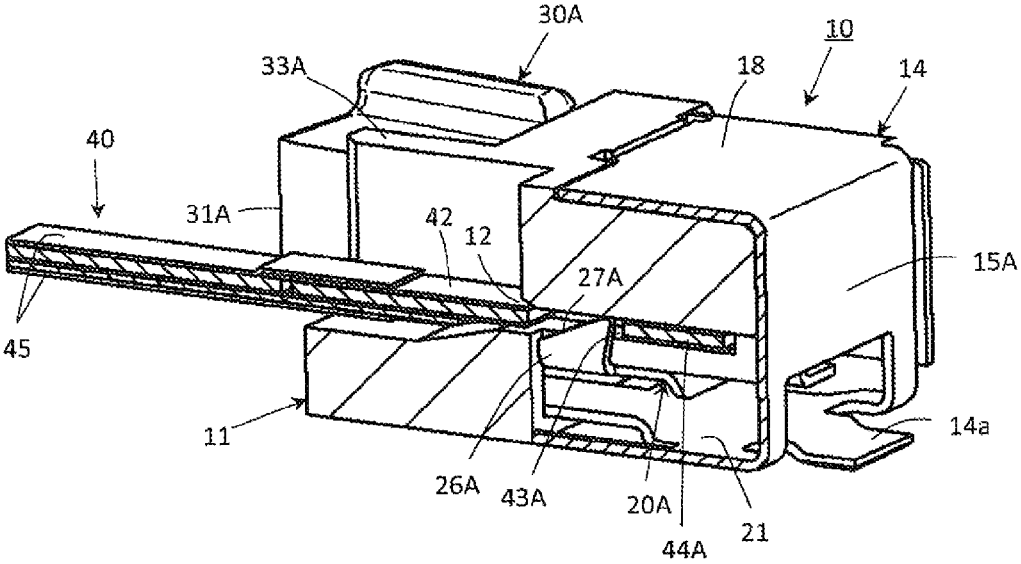
FIG. 15 is a schematic partial perspective view including a partial cross sectional view for showing the first embodiment shown in FIG. 1 and the FPC which is inserted in the housing of the first embodiment and held by an engaging portion of a holding member provided in the housing of the first embodiment.

Then, the FPC 40 is further inserted into the housing 11 to reach the predetermined destination in the housing 11. When the FPC 40 has reached the predetermined destination in the housing 11, the upper end part of the engaging portion 26A of the holding member 20A, on which the slanted end plane 27A is formed, is put out of the top flat portion 44A provided on the FPC 40 and shifted in position by the resilient arm portion of the holding member 20A restoring resiliently to go away from the lower plate portion 21 of the conductive shell 14, so that the engaging portion 26A of the holding member 20A engages with the engaging edged recess 43A provided on the FPC 40 for holding the FPC 40, at the left end portion of the housing 11, as shown in FIG. 15.

In addition, although illustrations are omitted, at the right end portion of the housing 11 also, the upper end part of the engaging portion 26B of the holding member 20B, on which the slanted end plane 27B is formed, is put out of the top flat portion 44B provided on the FPC 40 and shifted in position by the resilient arm portion of the holding member 20B restoring resiliently to go away from the lower plate portion 21 of the conductive shell 14, so that the engaging portion 26B of the holding member 20B engages with the engaging edged recess 43B provided on the FPC 40 for holding the FPC 40.

On that occasion, the FPC 40 inserted in the housing 11 has reached the predetermined destination in the housing 11 and held by the couple of the holding members 20A and 20B provided respectively at the left and right end portions of the housing 11 so as to be prevented from getting out of the housing 11 unwillingly. This results in that the FPC 40 is automatically put in a condition to be prevented from getting out of the housing 11 unwillingly only by means of being inserted into the housing 11.

When the FPC 40 inserted in the housing 11 has reached the predetermined destination in the housing 11 as shown in FIG. 13, the engaging edged recess 43A provided on the FPC 40 can not be observed through the vertical groove 38A provided on the front end portion of the housing 11 in a bird's-eye view of the electrical connector 10 fixed to the solid circuit board on which the housing 11 is mounted and similarly the engaging edged recess 43B provided on the FPC 40 can not be observed through the vertical groove 38B provided on the front end portion of the housing 11 in a bird's-eye view of the electrical connector 10 fixed to the solid circuit board on which the housing 11 is mounted. Thereby, the condition wherein the FPC 40 inserted in the housing 11 has reached the predetermined destination in the housing 11 can be easily confirmed by means of observing the FPC 40 inserted in the housing 11 through each of the vertical grooves 38A and 38B. If at least one of the engaging edged recesses 43A and 43B provided on the FPC 40 inserted in the housing 11 can be observed through at least one of the vertical grooves 38A and 38B provided on the front end portion of the housing 11, the FPC 40 inserted in the housing 11 has not reached the predetermined destination in the housing 11.

Under a condition wherein the FPC 40 inserted in the housing 11 takes up the predetermined destination in the housing 11 in the manner described above, each of the ground contacts 19 extending into the housing 11 from the belt-shaped plate portion 17 of the conductive shell 14 comes into resilient press-contact with the ground connecting portion 42 on the front surface of the FPC 40 from the side of the upper plate portion 18 of the conductive shell 14. As a result, the ground connecting portion 42 on the front surface of the FPC 40 inserted in the housing 11 is electrically connected through the ground contacts 19 with the grounded portion provided on the solid circuit board on which the housing 11 is mounted.

Further, each of the conductive contacts 13 arranged on the housing 11 also comes into resilient press-contact with a corresponding one of the signal connecting terminals 41 on the reverse surface of the FPC 40 from the side of the lower plate portion 21 of the conductive shell 14. As a result, the signal connecting terminals 41 on the reverse surface of the FPC 40 inserted in the housing 11 are electrically connected through the conductive contacts 13 with the circuit terminals provided on the solid circuit board on which the housing 11 is mounted.

Besides, the manipulatable portion 31A of the releasing member 30A provided on the housing 11 takes up the station shown in FIG. 10 and the pressing portion 32A of the releasing member 30A is positioned on the press-receiving portion 25A of the holding member 20A to be in contact with the slanted surface formed on the press-receiving portion 25A. Similarly, the manipulatable portion 31B of the releasing member 30B provided on the housing 11 takes up the station corresponding to the station of the manipulatable portion 31A of the releasing member 30A shown in FIG. 10 and the pressing portion 32B of the releasing member 30B is positioned on the press-receiving portion 25B of the holding member 20B to be in contact with the slanted surface formed on the press-receiving portion 25B.

Then, when the manipulatable portion 31A of the releasing member 30A is manipulated to move from the station shown in FIG. 10 in the longitudinal direction of the housing 11 along which the conductive contacts 13 are arranged so as to approach the movement-limiting portion 33A, the manipulatable portion 31A comes to take up the station shown in FIG. 11, for example, for coming into contact with the movement-limiting portion 33A so that the movement of the manipulatable portion 31A is limited by the movement-limiting portion 33A. With this movement of the manipulatable portion 31A of the releasing member 30A, the pressing portion 32A of the releasing member 30A is operative to move in the longitudinal direction of the housing 11 along which the conductive contacts 13 are arranged for pressing the slanted surface formed on the press-receiving portion 25A of the holding member 20A. Thereby, the press-receiving portion 25A of the holding member 20A causes the resilient arm portion of the holding member 20A to deform resiliently so as to shift in position downward in the direction perpendicular to the longitudinal direction of the housing 11 along which the conductive contacts 13 are arranged. With this shift of the press-receiving portion 25A of the holding member 20A, the engaging portion 26A of the holding member 20A shifts in position also downward in the direction perpendicular to the longitudinal direction of the housing 11 along which the conductive contacts 13 are arranged so as to disengage from the engaging edged recess 43A provided on the FPC 40 for releasing the FPC 40 from the holding by the holding member 20A.

In addition, when the manipulatable portion 31B of the releasing member 30B is manipulated to move from the station corresponding to the station of the manipulatable portion 31A of the releasing member 30A shown in FIG. 10 in the longitudinal direction of the housing 11 along which the conductive contacts 13 are arranged so as to approach the movement-limiting portion 33B, the manipulatable portion 31B comes to take up the station corresponding to the station of the manipulatable portion 31A of the releasing member 30A shown in FIG. 11, for example, for coming into contact with the movement-limiting portion 33B so that the movement of the manipulatable portion 31B is limited by the movement-limiting portion 33B. With this movement of the manipulatable portion 31B of the releasing member 30B, the pressing portion 32B of the releasing member 30B is operative to move in the longitudinal direction of the housing 11 along which the conductive contacts 13 are arranged for pressing the slanted surface formed on the press-receiving portion 25B of the holding member 20B. Thereby, the press-receiving portion 25B of the holding member 20B causes the resilient arm portion of the holding member 20B to deform resiliently so as to shift in position downward in the direction perpendicular to the longitudinal direction of the housing 11 along which the conductive contacts 13 are arranged. With this shift of the press-receiving portion 25B of the holding member 20B, the engaging portion 26B of the holding member 20B shifts in position also downward in the direction perpendicular to the longitudinal direction of the housing 11 along which the conductive contacts 13 are arranged so as to disengage from the engaging edged recess 43B provided on the FPC 40 for releasing the FPC 40 from the holding by the holding member 20B.

On that occasion, since the width of the resilient strip forming the folding portion 22A is selected to be equal to or larger than the width of the resilient strip forming the folding portion 23A in the holding member 20A having the folding portions 22A and 23A and the connecting portion 24A constituting the resilient arm portion, the folding portion 23A is equal in rigidity to or smaller in rigidity than the folding portion 22A and therefore the engaging portion 26A of the holding member 20A can be easily and surely shifted in position downward with the press-receiving portion 25A of the holding member 20A having the slanted surface pressed downward by the pressing portion 32A of the releasing member 30A. Similarly, since the width of the resilient strip forming the folding portion 22B is selected to be equal to or larger than the width of the resilient strip forming the folding portion 23B in the holding member 20B having the folding portions 22B and 23B and the connecting portion 24B constituting the resilient arm portion, the folding portion 23B is equal in rigidity to or smaller in rigidity than the folding portion 22B and therefore the engaging portion 26B of the holding member 20B can be easily and surely shifted in position downward with the press-receiving portion 25B of the holding member 20B having the slanted surface pressed downward by the pressing portion 32B of the releasing member 30B.

The press-receiving portion 25A of the holding member 20A is operative to exert a retroactive force directed upward on the pressing portion 32A of the releasing member 30A. This retroactive force from the press-receiving portion 25A of the holding member 20A is transferred through the manipulatable portion 31A of the releasing member 30A to the upper end portion of the housing 11 and then absorbed by the left plate-like engaging portion 28A which is provided on the left front end portion of the conductive shell 14 for engaging with the shell-receiving portion 34A provided on the left end portion of the housing 11, so that each of the left end portion of the housing 11 and the left end portion of the conductive shell 14 is prevented from being subjected to undesirable deformation or the like.

The press-receiving portion 25B of the holding member 20B is operative also to exert a retroactive force directed upward on the pressing portion 32B of the releasing member 30B. This retroactive force from the press-receiving portion 25B of the holding member 20B is transferred through the manipulatable portion 31B of the releasing member 30B to the upper end portion of the housing 11 and then absorbed by the right plate-like engaging portion 28B which is provided on the right front end portion of the conductive shell 14 for engaging with the shell-receiving portion 34B provided on the right end portion of the housing 11, so that each of the right end portion of the housing 11 and the right end portion of the conductive shell 14 is prevented from being subjected to undesirable deformation or the like.

The left plate-like engaging portion 28A provided on the conductive shell 14 is operative also to guide the manipulatable portion 31A of the releasing member 30A moving in the longitudinal direction of the housing 11 along which the conductive contacts 13 are arranged and similarly the right plate-like engaging portion 28B provided on the conductive shell 14 is operative also to guide the manipulatable portion 31B of the releasing member 30B moving in the longitudinal direction of the housing 11 along which the conductive contacts 13 are arranged.

As described above, when the manipulatable portion 31A of the releasing member 30A is manipulated, the engaging portion 26A of the holding member 20A shifts in position downward and disengages from the engaging edged recess 43A provided on the FPC 40 inserted in the housing 11 so that the FPC 40 is released from the holding by the holding member 20A, and when the manipulatable portion 31B of the releasing member 30B is manipulated, the engaging portion 26B of the holding member 20B shifts in position downward and disengages from the engaging edged recess 43B provided on the FPC 40 inserted in the housing 11 so that the FPC 40 is released from the holding by the holding member 20B. As a result, the FPC 40 is put in a condition to be able to get out of the housing 11.

In the case that the engaging edged holes are provided on the FPC 40 in place of the engaging edged recesses 43A and 43B, the FPC 40 inserted in the housing 11 is held by the holding members 20A and 20B and then released by the releasing members 30A and 30B from the holding by the holding members 20A and 20B in the same manner as described above.

After that, when the manipulatable portion 31A of the releasing member 30A is released from the manipulation acted thereon, the manipulatable portion 31A is operative to return to the station shown in FIG. 10 from the station shown in FIG. 11 with its own resilience and resilience of the resilient arm portion of the holding member 20A. With this returning movement of the manipulatable portion 31A of the releasing member 30A, the resilient arm portion of the holding member 20A is subjected to resilient restoring deformation and thereby each of the press-receiving portion 25A and the engaging portion 26A of the holding member 20A is shifted in position upward to return to the former position.

Similarly, when the manipulatable portion 31B of the releasing member 30B is released from the manipulation acted thereon, the manipulatable portion 31B is operative to return to the station corresponding to the station of the manipulatable portion 31A of the releasing member 30A shown in FIG. 10 from the station corresponding to the station of the manipulatable portion 31A of the releasing member 30A shown in FIG. 11 with its own resilience and resilience of the resilient arm portion of the holding member 20B. With this returning movement of the manipulatable portion 31B of the releasing member 30B, the resilient arm portion of the holding member 20B is subjected to resilient restoring deformation and thereby each of the press-receiving portion 25B and the engaging portion 26B of the holding member 20B is shifted in position upward to return to the former position.

With the electrical connector 10 as described above, the FPC 40 is automatically put in a condition wherein each of the holding members 20A and 20B is automatically put in engagement with the FPC 40 inserted in the housing 11 to hold the same, the signal connecting terminals 41 provided on the FPC 40 inserted in the housing 11 are electrically connected through the conductive contacts 13 arranged on the housing 11 with the circuit terminals provided on the solid circuit board on which the housing 11 is mounted, and the ground connecting portion 42 provided on the FPC 40 inserted in the housing 11 is electrically connected through the ground contacts 19 formed in the conductive shell 14 with the grounded portion provided on the solid circuit board on which the housing 11 is mounted, only by means of being inserted into the housing 11.

Further, With the electrical connector 10, it is not required, for causing the holding members 20A and 20B formed in the conductive shell 14 to be put in engagement with the FPC 40 inserted in the housing 11 to hold the same and then to be released by the releasing members 30A and 30B provided on the housing 11 from the engagement with the FPC 40 to put the same in free, to provide on the housing 11 an actuator rotatable in regard to the housing 11 or to set the conductive shell 14 to be rotatable in regard to the housing 11. Accordingly, the conductive shell 14 fixed to the housing 11 can be used for fastening the housing 11 to the solid circuit board and any additional member for fastening the housing 11 to the solid circuit board is not required. As a result, the electrical connector 10 is able to be constituted with a relatively small number of constitutive parts and at a production cost reduced effectively.

In the electrical connector 10, the holding member 20A is released from the engagement with the FPC 40 inserted in the housing 11 when the manipulatable portion 31A of the releasing member 30A, which projects from the inside to the outside of the housing 11 at the left end portion of the housing 11 neighboring the opening 12 provided on the front end portion of the housing 11, is moved in the longitudinal direction of the housing 11 along which the conductive contacts 13 are arranged, and the holding member 20B is also released from the engagement with the FPC 40 inserted in the housing 11 when the manipulatable portion 31B of the releasing member 30B, which projects from the inside to the outside of the housing 11 at the right end portion of the housing 11 neighboring the opening 12 provided on the front end portion of the housing 11, is moved in the longitudinal direction of the housing 11 along which the conductive contacts 13 are arranged. Therefore, each of the holding members 20A and 20B is able to be released from the engagement with the FPC 40 inserted in the housing 11 by an extremely simple and easy manipulation.

Since the manipulatable portion 31A of the releasing member 30A is provided to project from the inside to the outside of the housing 11 at the left side portion of the housing 11 neighboring the opening 12 provided on the front end portion of the housing 11 and not to project upward from the housing 11 toward the outside of the conductive shell 14 on the side of the upper surface of the housing 11, and the manipulatable portion 31B of the releasing member 30B is provided to project from the inside to the outside of the housing 11 at the right side portion of the housing 11 neighboring the opening 12 provided on the front end portion of the housing 11 and not to project upward from the housing 11 toward the outside of the conductive shell 14 on the side of the upper surface of the housing 11, each of the manipulatable portion 31A of the releasing member 30A and the manipulatable portion 31B of the releasing member 30B has no effect on a measure of thickness of the housing 11 in a direction perpendicular to the solid circuit board on which the housing 11 is mounted. Consequently, with the electrical connector 10, the measure of thickness of the housing 11 can be reduced sufficiently to obtain a thin circuit board assembly.

Besides, with the electrical connector 10, since the holding member 20A is released from the engagement with the FPC 40 inserted in the housing 11 when the manipulatable portion 31 A of the releasing member 30A is moved in the longitudinal direction of the housing 11 along which the conductive contacts 13 are arranged and which is perpendicular to a direction from the upper surface to the lower surface of the housing 11 and the holding member 20B is released from the engagement with the FPC 40 inserted in the housing 11 when the manipulatable portion 31B of the releasing member 30B is moved in the longitudinal direction of the housing 11 along which the conductive contacts 13 are arranged and which is perpendicular to the direction from the upper surface to the lower surface of the housing 11, the FPC 40 inserted in the housing 11 can be surely put in holding by the holding members 20A and 20B to be prevented from getting out of the housing 11 unwillingly and then released from the holding by the holding members 20A and 20B so as to be able to get out of the housing 11 under a condition wherein an open space enough to conduct the manipulation for releasing the FPC 40 from the holding by the holding members 20A and 20B is not required to be kept above the housing 11 covered partially by the conductive shell 14 on the solid circuit board.

Figure 16:
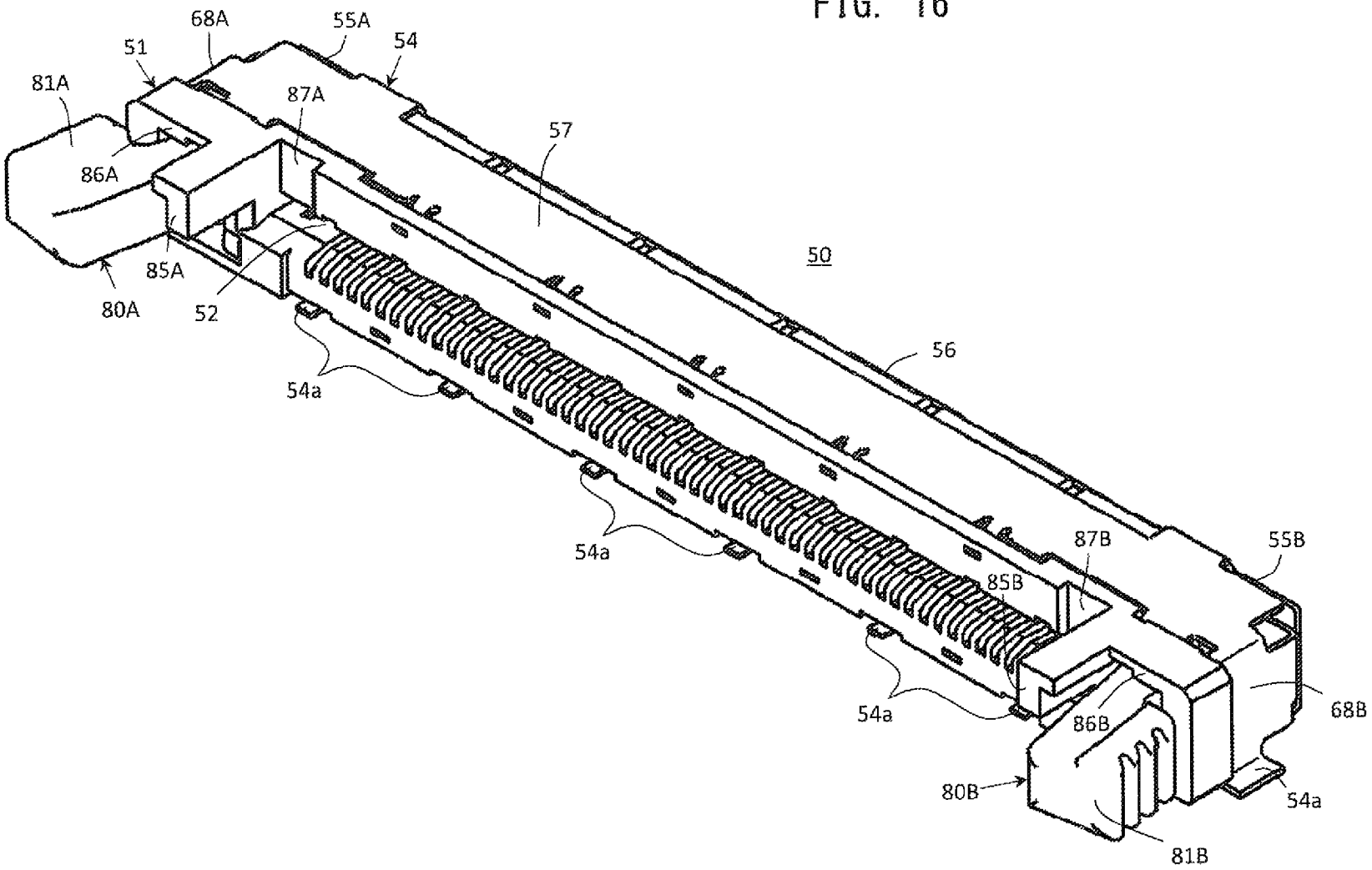
FIG. 16 is a schematic front, top and left side perspective view showing a second embodiment of electrical connector according to the present invention.

FIG. 16 shows a second embodiment of electrical connector according to the present invention.

Referring to FIG. 16, an electrical connector 50, which constitutes the second embodiment of electrical connector according to the present invention, has a housing 51 made of insulator, such as plastics or the like. The housing 51 is provided on a front end portion thereof with an opening 52 through which a flat circuit device, such as an FPC, is inserted into the housing 51 and further provided with a room extending from the opening 52 into the inside of the housing 51 for accommodating the flat circuit device inserted in the housing 51. The front end portion of the housing 51 is constituted with a part of the housing 51 forming the opening 52 and a part of the housing 51 surrounding the part of the housing 51 forming the opening 52.

When the electrical connector 50 is put in practical use for mounting, for example, an FPC which constitutes the flat circuit device, on a solid circuit board in an electronic apparatus (not shown in the drawings), the housing 51 is mounted on the solid circuit board so that the electrical connector 50 is fixed in its entirety to the solid circuit board. The housing 51 mounted on the solid circuit board has an upper surface which is an outer surface of an upper end portion of the housing 51 and open to a space on the solid circuit board and a lower surface which is an outer surface of a lower end portion of the housing 51 and opposite to the upper surface to face the solid circuit board.

A plurality of conductive contacts 53, which correspond to the conductive contacts 13 employed in the electrical connector 10 described above and are not shown in FIG. 16 but shown in FIG. 21 described later, are provided on the housing 51 to be arranged in a longitudinal direction of the housing 51 extending along a surface of the solid circuit board on which the housing 51 is mounted. Each of the conductive contacts 53 is constituted in the same manner as each of the conductive contacts 13 employed in the electrical connector 10 to have a connecting terminal 53*a* which corresponding to the connecting terminal portion 13*a* of the conductive contact 13. The conductive contacts 53 thus constituted are operative to perform the same function as that performed by the conductive contacts 13 employed in the electrical connector 10.

When the FPC is inserted into the housing 51 through the opening 52 provided thereon, the conductive contacts 53 come into press-contact with connecting terminals provided on the FPC inserted in the housing 51, respectively. Therefore, the connecting terminals provided on the FPC inserted in the housing 51 are electrically connected through the conductive contacts 53 with circuit terminals provided on the solid circuit board on which the housing 51 is mounted.

The electrical connector 50 has also a conductive shell 54 mounted on the housing 51 for covering a major part of the housing 51 except the front end portion of the housing 51 on which the opening 52 is provided. To be more concrete, the conductive shell 54 covers a large part of the upper end portion of the housing 51, a large part of each of left and right side end portions of the housing 51, a part of the lower end portion of the housing 51 and a part of the rear end portion of the housing 51. The conductive shell 54 thus mounted on the housing 51 has a longitudinal direction thereof extending in the same manner as the longitudinal direction of the housing 51.

Figure 17:
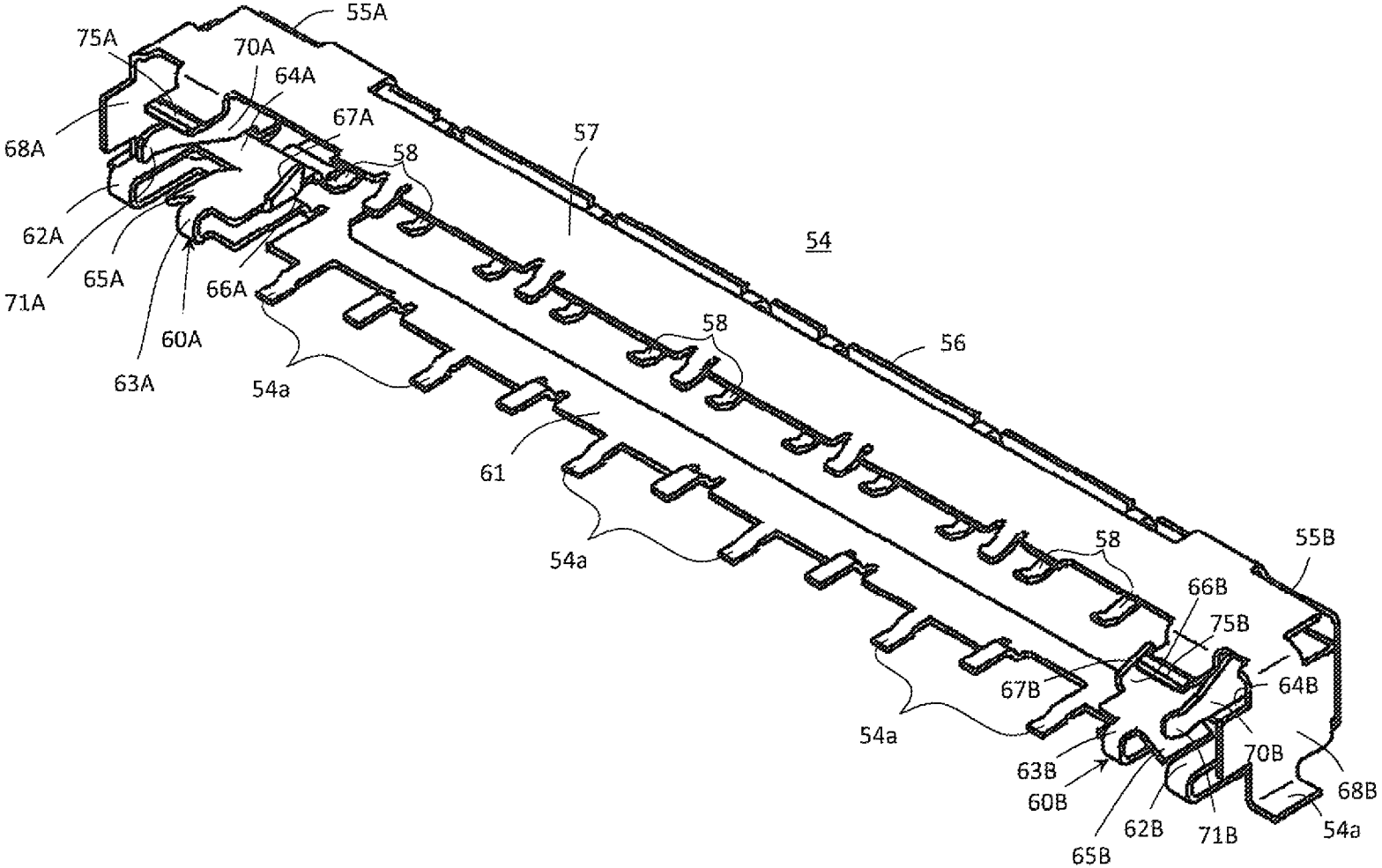
FIG. 17 is a schematic front, top and right side perspective view showing a conductive shell employed in the second embodiment shown in FIG. 16.
Figure 18:
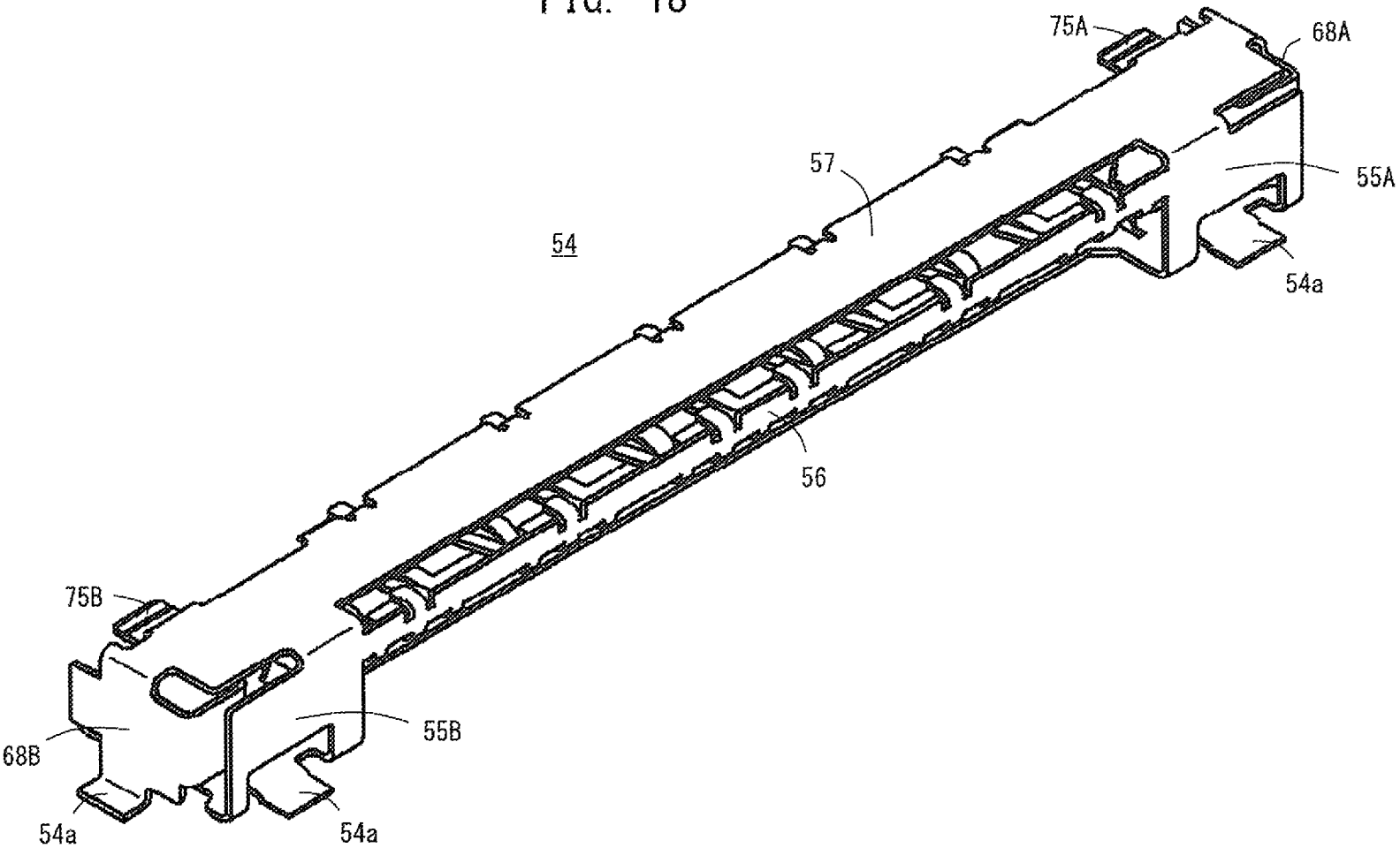
FIG. 18 is a schematic rear, top and right side perspective view showing the conductive shell shown in FIG. 17.
Figure 19:
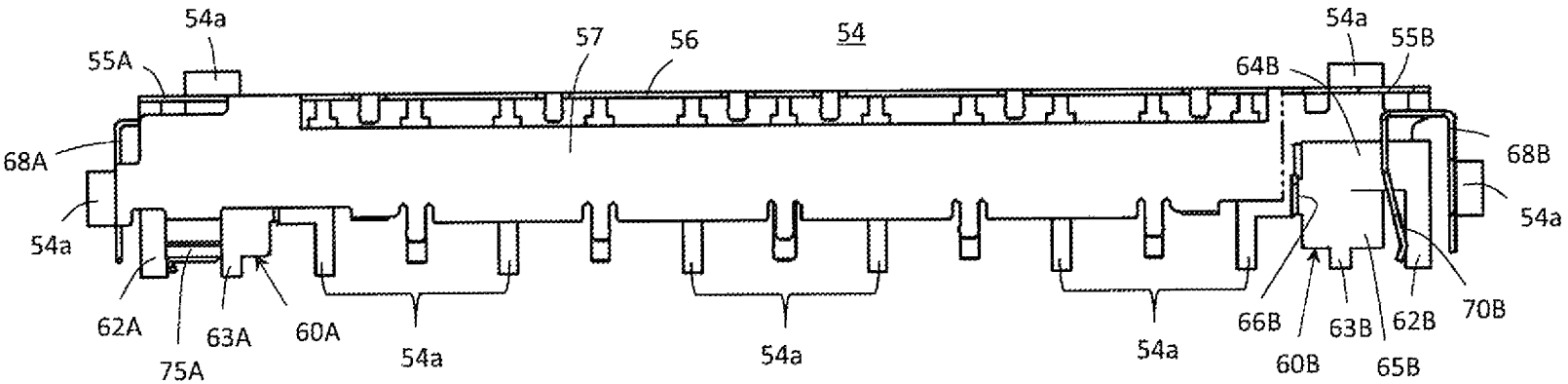
FIG. 19 is a schematic plan and fragmentary view showing the conductive shell shown in FIG. 17.

Each of FIG. 17 which is a schematic front, top and right side perspective view, FIG. 18 which is a schematic rear, top and right side perspective view and FIG. 19 which is a schematic plan and partially fragmentary view, shows the conductive shell 54 removed from the housing 51.

Referring FIGS. 17, 18 and 19, the conductive shell 54 is formed by means of processing a metal thin plate to have a plurality of ground connecting portions 54*a*, each of which is operative to be connected electrically by, for example, soldering with grounded portions provided on the solid circuit board on which the housing 51 is mounted.

Since the conductive shell 54 is formed to cover the major part of the upper end portion of the housing 51, the left side end portion of the housing 51 and the right side end portion of the housing 51 when the conductive shell 54 is mounted on the housing 51 and each of the ground connecting portions 54*a* provided on the conductive shell 54 is connected electrically by, for example, soldering with the grounded portion provided on the solid circuit board on which the housing 51 is mounted, as described above, the conductive contacts 53 provided on the housing 51 are sufficiently shielded by the conductive shell 54 from the electromagnetic wave noises coming from the outside. In addition, the conductive shell 54 mounted on the housing 51 is able to be used for fastening the housing 51 to the solid circuit board on which the housing 51 is mounted.

Further, the conductive shell 54 is provided with a belt-shaped plate portion 56 separated from an upper plate portion 57 of the conductive shell 54 covering the upper end portion of the housing 51 for connecting a pair of left and right rear plate portions 55A and 55B of the conductive shell 54 with each other on the rear end portion of the housing 51. The left rear plate portion 55A of the conductive shell 54 covers a left end part of the rear end portion of the housing 51 and the right rear plate portion 55B of the conductive shell 54 covers a right end part of the rear end portion of the housing 51. The belt-shaped plate portion 56 is provided thereon with a plurality of ground contacts 58. Each of the ground contacts 58 extends into the housing 51 toward the opening 52 formed in the front end portion of the housing 51 from the belt-shaped plate portion 56. In the housing 51, the ground contacts 58 is positioned to be opposite to a corresponding one of the conductive contacts 53 and operative to come into press-contact with a ground connecting portion provided on the FPC when the FPC is inserted in the housing 51 through the opening 52 provided thereon.

The conductive shell 54 is also provided with a couple of holding members 60A and 60B for holding the FPC inserted in the housing 51 through the opening 52 provided thereon. The holding member 60A is formed in a body in the conductive shell 54 at a position opposite to the left rear plate portion 55A of the conductive shell 54 and the holding member 60B is also formed in a body in the conductive shell 54 at a position opposite to the right rear plate portion 55B of the conductive shell 54.

The holding member 60A is provided with a pair of folding portions 62A and 63A, each of which extends first from a left end of a lower plate portion 61 of the conductive shell 54 covering the lower end portion of the housing 51 toward the front end portion of the housing 51 and then folds back to extend toward the left rear plate portion 55A of the conductive shell 54, a connecting portion 64A for connecting the folding portions 62A and 63A with each other, a press-receiving portion 65A projecting from the folding portion 63A, and an engaging portion 66A provided on the folding portion 63A. In the holding member 60A thus constituted, the folding portions 62A and 63A and the connecting portion 64A in the aggregate constitute a resilient arm portion which is operative to shift in position resiliently in a direction passing through both of the upper and lower surfaces of the housing 51, so that the resilient arm portion is operative to support the engaging portion 66A to be shiftable in position in the direction passing through both of the upper and lower surfaces of the housing 51 and the press-receiving portion 65A projects from the resilient arm portion.

Each of the folding portions 62A and 63A is shaped into a resilient strip with a predetermined width. The width of the resilient strip forming the folding portion 62A is selected to be equal to or larger than the width of the resilient strip forming the folding portion 63A. The press-receiving portion 65A forms thereon a slanted surface inclined to the longitudinal direction of the housing 51, that is, the direction along which the conductive contacts 53 are arranged. Further, the engaging portion 66A constitutes a projection standing up on the folding portion 63A forming the resilient arm portion toward the upper plate portion 57 of the conductive shell 54 and is operative to shift in position with the shift of the resilient arm portion in the direction passing through both of the upper and lower surfaces of the housing 51.

Similarly, the holding member 60B is provided with a pair of folding portions 62B and 63B, each of which extends first from a right end of the lower plate portion 61 of the conductive shell 54 toward the front end portion of the housing 51 and then folds back to extend toward the right rear plate portion 55B of the conductive shell 54, a connecting portion 64B for connecting the folding portions 62B and 63B with each other, a press-receiving portion 65B projecting from the folding portion 63B, and an engaging portion 66B provided on the folding portion 63B. In the holding member 60B thus constituted, the folding portions 62B and 63B and the connecting portion 64B in the aggregate constitute a resilient arm portion which is operative to shift in position resiliently in the direction passing through both of the upper and lower surfaces of the housing 51, so that the resilient arm portion is operative to support the engaging portion 66B to be shiftable in position in the direction passing through both of the upper and lower surfaces of the housing 51 and the press-receiving portion 65B projects from the resilient arm portion.

Each of the folding portions 62B and 63B is shaped into a resilient strip with a predetermined width. The width of the resilient strip forming the folding portion 62B is selected to be equal to or larger than the width of the resilient strip forming the folding portion 63B. The press-receiving portion 65B forms thereon a slanted surface inclined to the longitudinal direction of the housing 51 along which the conductive contacts 53 are arranged. Further, the engaging portion 66B constitutes a projection standing up on the folding portion 63B forming the resilient arm portion toward the upper plate portion 57 of the conductive shell 54 and is operative to shift in position with the shift of the resilient arm portion in the direction passing through both of the upper and lower surfaces of the housing 51.

The engaging portion 66A of the holding member 60A, which constitutes the projection standing up on the folding portion 63A forming the resilient arm portion toward the upper plate portion 57 of the conductive shell 54, has an upper end part forming thereon a slanted end plane 67A ascending gradually in a direction along which the FPC is inserted into the housing 51 through the opening 52 provided thereon. The upper end part of the engaging portion 66A forming thereon the slanted end plane 67A is positioned in the inside of the conductive shell 54 for engaging with an engaging edged recess provided on the FPC inserted in the housing 51, as described later.

Similarly, the engaging portion 66B of the holding member 60B, which constitutes the projection standing up on the folding portion 63B forming the resilient arm portion toward the upper plate portion 57 of the conductive shell 54, has an upper end part forming thereon a slanted end plane 67B ascending gradually in the direction along which the FPC is inserted into the housing 51 through the opening 52 provided thereon. The upper end part of the engaging portion 66B forming thereon the slanted end plane 67B is positioned in the inside of the conductive shell 54 for engaging with an engaging edged recess provided on the FPC inserted in the housing 51, as described later.

Further, the conductive shell 54 is provided, in addition to the holding members 60A and 60B, with a pair of resilient engaging portions 70A and 70B each formed in a body on the conductive shell 54 to be shaped into a cantilever. The resilient engaging portion 70A extends from a rear end of a left side end portion 68A covering the left side end portion of the housing 51 into the inside of the conductive shell 54 for bending toward the front end portion of the housing 51 so as to be positioned immediately in the vicinity of the holding member 60A. The resilient engaging portion 70B extends from a rear end of a right side end portion 68B covering the right side end portion of the housing 51 into the inside of the conductive shell 54 for bending toward the front end portion of the housing 51 so as to be positioned immediately in the vicinity of the holding member 60B.

A top end part 71A of the resilient engaging portion 70A is put in a position corresponding to the front end portion of the housing 51 in the vicinity of the holding member 60A for engaging with a manipulatable portion 81A of a releasing member 80A explained later. Similarly, a top end part 71B of the resilient engaging portion 70B is put in a position corresponding to the front end portion of the housing 51 in the vicinity of the holding member 60B for engaging with a manipulatable portion 81B of a releasing member 80B explained later. Each of the resilient engaging portions 70A and 70B is provided to be movable in the longitudinal direction of the conductive shell 54 along which the conductive contacts 53 are arranged.

The resilient engaging portion 70A is operative to apply on the manipulatable portion 81A of the releasing member 80A, with which the top end part 71A of the resilient engaging portion 70A is put in engagement, a resilient force contributing to a returning movement of the manipulatable portion 81A when the manipulatable portion 81A of the releasing member 80A is moved in the longitudinal direction of the housing 51 along which the conductive contacts 53 are arranged. Similarly, the resilient engaging portion 70B is operative to apply on the manipulatable portion 81B of the releasing member 80B, with which the top end part 71B of the resilient engaging portion 70B is put in engagement, a resilient force contributing to a returning movement of the manipulatable portion 81B when the manipulatable portion 81B of the releasing member 80B is moved in the longitudinal direction of the housing 51 along which the conductive contacts 53 are arranged.

Besides, the conductive shell 54 is provide on a left front end portion opposite to the left rear plate portion 55A thereof with a left plate-like engaging portion 75A which extends from a left end of the upper plate portion 57 of the conductive shell 54 toward the outside of the conductive shell 54 for engaging with a left end portion of the housing 51 which neighbors the opening 52 provided on the front end portion of the housing 51 and provided also on a right front end portion opposite to the right rear plate portion 55B thereof with a right plate-like engaging portion 75B which extends from a right end of the upper plate portion 57 of the conductive shell 54 toward the outside of the conductive shell 54 for engaging with a right end portion of the housing 51 which neighbors the opening 52 provided on the front end portion of the housing 51.

Figure 20:
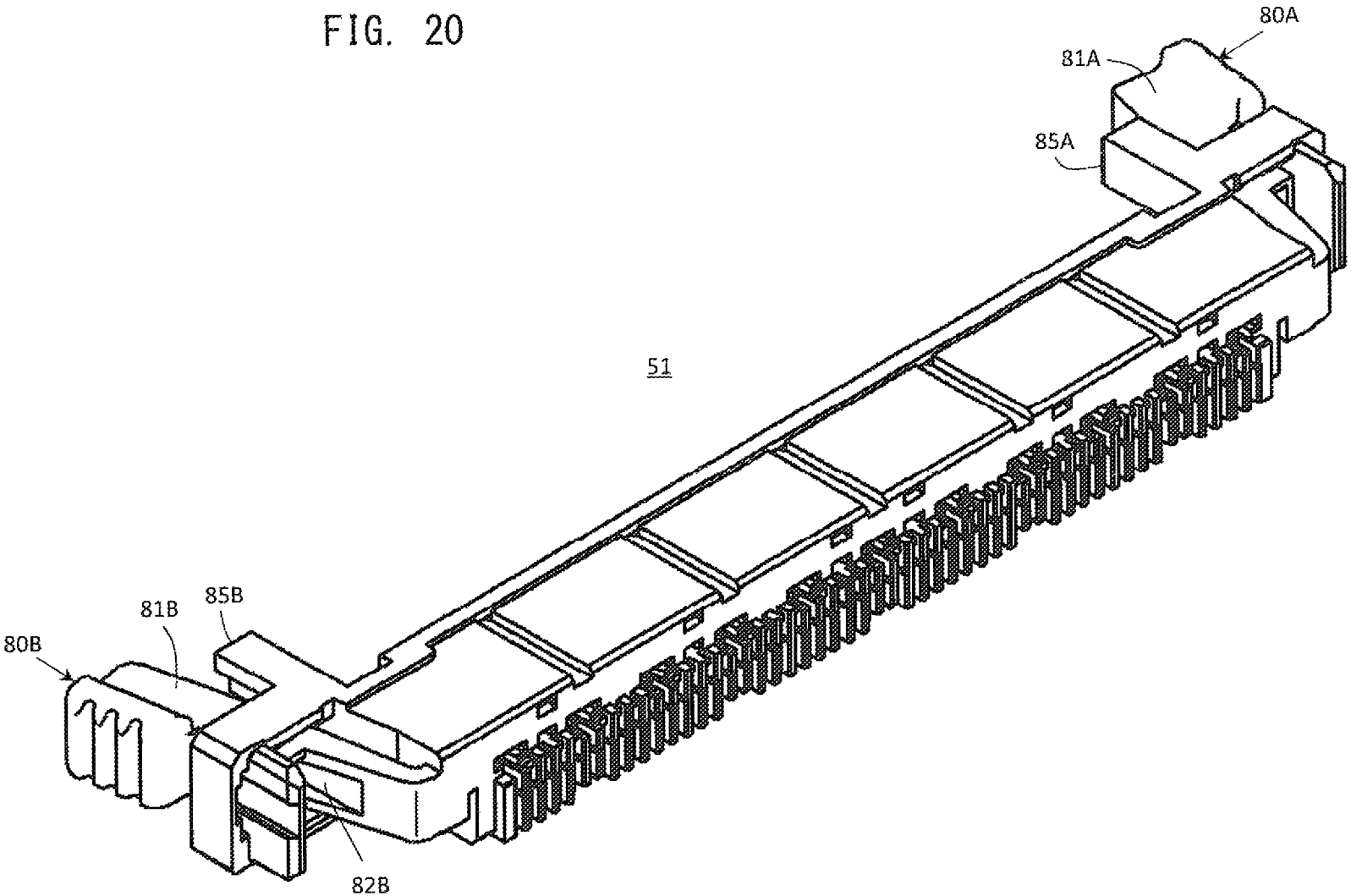
FIG. 20 is a schematic rear, top and right side perspective view showing a housing employed in the second embodiment shown in FIG. 16.

FIG. 20 shows the housing 51 from which the conductive contacts 53 and the conductive shell 54 are removed.

Referring to FIG. 20, the housing 51 is provided on the left and right end portions thereof with a couple of releasing members 80A and 80B to be manipulated for releasing the FPC inserted in the housing 51 from holding by the holding members 60A and 60B. The releasing member 80A is provided in a body on the housing 51 at a position corresponding to the holding member 60A and the releasing member 80B is also provided in a body on the housing 51 at a position corresponding to the holding member 60B.

Figure 21:
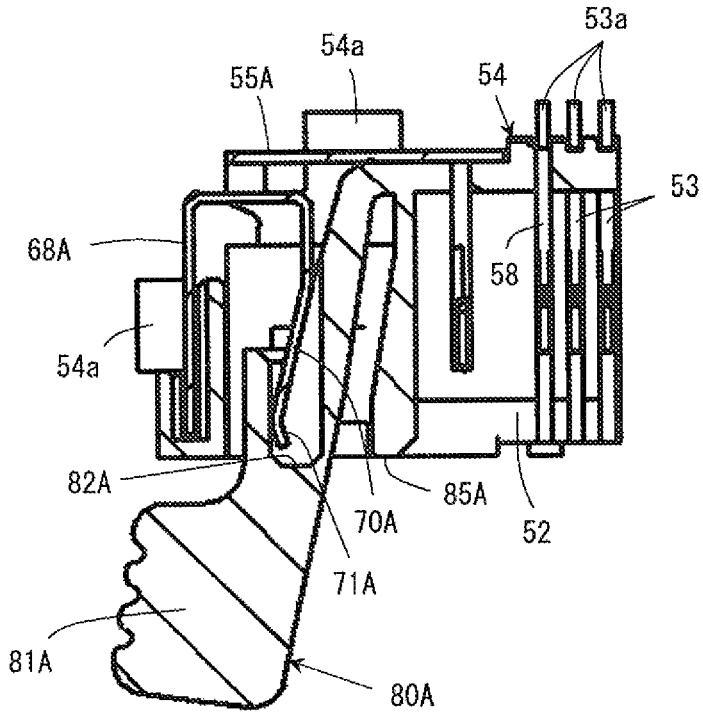
FIG. 21 is a schematic partial cross sectional view showing the inside of a part of the second embodiment shown in FIG. 1.

As shown in FIG. 21 which is a schematic partial cross sectional view showing an inside structure of a left end portion of the electrical connector 50, the releasing member 80A has the manipulatable portion 81A extending from the rear end portion of the housing 51 toward the outside of the front end portion of the housing 51 so as to project from the inside to the outside of the housing 51 at the left end portion of the housing 51 neighboring the opening 52 provided on the front end portion of the housing 51 and a pressing portion (not shown in the drawings) projecting downward from a lower end of the manipulatable portion 81A in the same manner as the pressing portion 32A projecting downward from the lower end of the manipulatable portion 31A employed in the electrical connector 10.

The manipulatable portion 81A of the releasing member 80A is provided to be resilient and movable in the longitudinal direction of the housing 51 along which the conductive contacts 53 are arranged. The pressing portion projecting downward from the manipulatable portion 81A of the releasing member 80A is provided to engage with the slanted surface formed on the press-receiving portion 65A of the holding member 60A. When the manipulatable portion 81A of the releasing member 80A is manipulated to move in the longitudinal direction of the housing 51 along which the conductive contacts are arranged, the pressing portion projecting downward from the manipulatable portion 81A of the releasing member 80A is moved also in the longitudinal direction of the housing 51 along which the conductive contacts 53 are arranged, together with the manipulatable portion 81A.

As shown in FIG. 21, the manipulatable portion 81A of the releasing member 80A is provided thereon with an engaging recess 82A constituting a groove-shaped portion, with which the top end part 71A of the resilient engaging portion 70A formed on the conductive shell 54 engages. That is, the engaging recess 82A is provided on the manipulatable portion 81A of the releasing member 80A to constitute the groove-shaped portion for receiving the top end part 71A of the resilient engaging portion 70A.

The releasing member 80B has the manipulatable portion 81B extending from the rear end portion of the housing 51 toward the outside of the front end portion of the housing 51 so as to project from the inside to the outside of the housing 51 at the right end portion of the housing 51 neighboring the opening 52 provided on the front end portion of the housing 51 and a pressing portion (not shown in the drawings) projecting downward from a lower end of the manipulatable portion 81B in the same manner as the pressing portion 32B projecting downward from the lower end of the manipulatable portion 31B employed in the electrical connector 10.

The manipulatable portion 81B of the releasing member 80B is provided to be resilient and movable in the longitudinal direction of the housing 51 along which the conductive contacts 53 are arranged. The pressing portion projecting downward from the manipulatable portion 81B of the releasing member 80B is provided to engage with the slanted surface formed on the press-receiving portion 65B of the holding member 60B. When the manipulatable portion 81B of the releasing member 80B is manipulated to move in the longitudinal direction of the housing 51 along which the conductive contacts are arranged, the pressing portion projecting downward from the manipulatable portion 81B of the releasing member 80B is moved also in the longitudinal direction of the housing 51 along which the conductive contacts 53 are arranged, together with the manipulatable portion 81B.

As shown in FIG. 20, The manipulatable portion 81B of the releasing member 80B is provided thereon with an engaging recess 82B constituting a groove-shaped portion, with which the top end part 71B of the resilient engaging portion 70B formed on the conductive shell 54 engages. That is, the engaging recess 82B is provided on the manipulatable portion 81B of the releasing member 80B to constitute the groove-shaped portion for receiving the top end part 71B of the resilient engaging portion 70B.

On the left end portion of the housing 51 neighboring the opening 52 provided on the front end portion of the housing 51, a movement-limiting portion 85A for limiting a movement of the manipulatable portion 81A of the releasing member 80A in the longitudinal direction of the housing 51 along which the conductive contacts 53 are arranged is provided to be in the vicinity of the manipulatable portion 81A of the releasing member 80A for projecting from the housing 51 toward the outside of the housing 51. Similarly, on the right end portion of the housing 51 neighboring the opening 52 provided on the front end portion of the housing 51, a movement-limiting portion 85B for limiting a movement of the manipulatable portion 81B of the releasing member 80B in the longitudinal direction of the housing 51 along which the conductive contacts 53 are arranged is also provided to be in the vicinity of the manipulatable portion 81B of the releasing member 80B for projecting from the housing 51 toward the outside of the housing 51.

Further, as shown in FIG. 16, on the left end portion of the housing 51 neighboring the opening 52 provided on the front end portion of the housing 51, a shell-receiving portion 86A is provided to be positioned above the manipulatable portion 81A of the releasing member 80A for receiving the left plate-like engaging portion 75A provided on the left front end portion of the conductive shell 54. Similarly, on the right end portion of the housing 51 neighboring the opening 52 provided on the front end portion of the housing 51, a shell-receiving portion 86B is also provided to be positioned above the manipulatable portion 81B of the releasing member 80B for receiving the right plate-like engaging portion 75B provided on the right front end portion of the conductive shell 54.

Besides, a couple of vertical grooves 87A and 87B are provided on the front end portion of the housing 51 in addition to the opening 52. Each of the vertical grooves 87A and 87B is used for observing therethrough a condition wherein the FPC inserted in the housing 51 through the opening 52 provided thereon has reached a predetermined destination in the housing 51.

In the electrical connector 50 having the housing 51 on which the conductive contacts 53 are arranged and the conductive shell 54 mounted on the housing 51 for covering partially the same, as described above, the top end part 71A of the resilient engaging portion 70A formed on the conductive shell 54 is put in engagement with the engaging recess 82A provided on the manipulatable portion 81A of the releasing member 80A provided on the housing 51 and the top end part 71B of the resilient engaging portion 70B formed on the conductive shell 54 is put in engagement with the engaging recess 82B provided on the manipulatable portion 81B of the releasing member 80B provided on the housing 51. Then, when the manipulatable portion 81A of the releasing member 80A is manipulated to move in the longitudinal direction of the housing 51 along which the conductive contacts 53 are arranged for approaching the movement-limiting portion 85A, the manipulatable portion 81A of the releasing member 80A moves in the longitudinal direction of the housing 51 along which the conductive contacts 53 are arranged together with the resilient engaging portion 70A and the resilient engaging portion 70A is operative to apply on the manipulatable portion 81A of the releasing member 80A the resilient force contributing to the returning movement of the manipulatable portion 81A. Similarly, when the manipulatable portion 81B of the releasing member 80B is manipulated to move in the longitudinal direction of the housing 51 along which the conductive contacts 53 are arranged for approaching the movement-limiting portion 85B, the manipulatable portion 81B of the releasing member 80B moves in the longitudinal direction of the housing 51 along which the conductive contacts 53 are arranged together with the resilient engaging portion 70B and the resilient engaging portion 70B is operative to apply on the manipulatable portion 81B of the releasing member 80B the resilient force contributing to the returning movement of the manipulatable portion 81B.

Under such a condition as described above, the manipulatable portion 81A of the releasing member 80A provided on the housing 51 takes up such a station as shown in FIG. 16 when any manipulation does not act on the manipulatable portion 81A. On that occasion, the pressing portion projecting downward from the manipulatable portion 81A of the releasing member 80A is positioned on the press-receiving portion 65A of the holding member 60A to be in contact with the slanted surface formed on the press-receiving portion 65A.

When the manipulatable portion 81A of the releasing member 80A is manipulated to move from the station shown in FIG. 16 in the longitudinal direction of the housing 51 along which the conductive contacts 53 are arranged so as to approach the movement-limiting portion 85A, the manipulatable portion 81A moves together with the resilient engaging portion 70A in the longitudinal direction of the housing 51 along which the conductive contacts 53 are arranged, for example, to come into contact with the movement-limiting portion 85A so that the movement of the manipulatable portion 81A is limited by the movement-limiting portion 85A.

With such a movement of the manipulatable portion 81A of the releasing member 80A, the pressing portion projecting downward from the manipulatable portion 81A of the releasing member 80A is operative to move in the longitudinal direction of the housing 51 along which the conductive contacts 53 are arranged for pressing the slanted surface formed on the press-receiving portion 65A of the holding member 60A. Thereby, the press-receiving portion 65A of the holding member 60A causes the resilient arm portion of the holding member 60A to deform resiliently so as to shift in position downward in the direction perpendicular to the longitudinal direction of the housing 51 along which the conductive contacts 53 are arranged. With such a shift of the press-receiving portion 65A of the holding member 60A, the engaging portion 66A of the holding member 60A shifts in position also downward in the direction perpendicular to the longitudinal direction of the housing 51 along which the conductive contacts 53 are arranged.

After that, when the manipulatable portion 81A of the releasing member 80A is released from the manipulation acted thereon, the manipulatable portion 81A is operative to return to the station shown in FIG. 16 with its own resilience and resilience of the resilient arm portion of the holding member 60A. With such a returning movement of the manipulatable portion 81A of the releasing member 80A, the resilient arm portion of the holding member 60A is subjected to resilient restoring deformation and thereby each of the press-receiving portion 65A and the engaging portion 66A of the holding member 60A is shifted in position upward to return to a former position. On that occasion, the returning movement of the manipulatable portion 81A of the releasing member 80A is conducted surely and quickly with the resilient force applied on the manipulatable portion 81A by the resilient engaging portion 70A so as to contribute the returning movement of the manipulatable portion 81A.

The manipulatable portion 81B of the releasing member 80B provided on the housing 51 also takes up such a station as shown in FIG. 16 when any manipulation does not act on the manipulatable portion 81B. On that occasion, the pressing portion projecting downward from the manipulatable portion 81B of the releasing member 80B is positioned on the press-receiving portion 65B of the holding member 60B to be in contact with the slanted surface formed on the press-receiving portion 65B.

When the manipulatable portion 81B of the releasing member 80B is manipulated to move from the station shown in FIG. 16 in the longitudinal direction of the housing 51 along which the conductive contacts 53 are arranged so as to approach the movement-limiting portion 85B, the manipulatable portion 81B moves together with the resilient engaging portion 70B in the longitudinal direction of the housing 51 along which the conductive contacts 53 are arranged, for example, to come into contact with the movement-limiting portion 85B so that the movement of the manipulatable portion 81B is limited by the movement-limiting portion 85B.

With such a movement of the manipulatable portion 81B of the releasing member 80B, the pressing portion projecting downward from the manipulatable portion 81B of the releasing member 80B is operative to move in the longitudinal direction of the housing 51 along which the conductive contacts 53 are arranged for pressing the slanted surface formed on the press-receiving portion 65B of the holding member 60B. Thereby, the press-receiving portion 65B of the holding member 60B causes the resilient arm portion of the holding member 60B to deform resiliently so as to shift in position downward in the direction perpendicular to the longitudinal direction of the housing 51 along which the conductive contacts 53 are arranged.

With such a shift of the press-receiving portion 65B of the holding member 60B, the engaging portion 66B of the holding member 60B shifts in position also downward in the direction perpendicular to the longitudinal direction of the housing 51 along which the conductive contacts 53 are arranged.

After that, when the manipulatable portion 81B of the releasing member 80B is released from the manipulation acted thereon, the manipulatable portion 81B is operative to return to the station shown in FIG. 16 with its own resilience and resilience of the resilient arm portion of the holding member 60B. With such a returning movement of the manipulatable portion 81B of the releasing member 80B, the resilient arm portion of the holding member 60B is subjected to resilient restoring deformation and thereby each of the press-receiving portion 65B and the engaging portion 66B of the holding member 60B is shifted in position upward to return to a former position. On that occasion, the returning movement of the manipulatable portion 81B of the releasing member 80B is conducted surely and quickly with the resilient force applied on the manipulatable portion 81B by the resilient engaging portion 70B so as to contribute the returning movement of the manipulatable portion 81B.

As described above, the electrical connector 50 is provided at both end portions thereof in the longitudinal direction of each of the housing 51 and the conductive shell 54 respectively with a couple of holding members 60A and 60B and a couple of releasing members 80A and 80B.

In the electrical connector 50 constituted as described above, for example, the FPC 40 shown in FIG. 12 which is the example of the FPC constituting the flat circuit device is inserted into the housing 51 through the opening 52 provided on the front end portion of the housing 51.

When the FPC 40 is inserted into the housing 51 of the electrical connector 50 through the opening 52 provided on the housing 51, the folding portions 62A and 63A, the connecting portion 64A, the press-receiving portion 65A, the engaging portion 66A and the slanted end plane 67A, which constitute the holding member 60A employed in the electrical connector 50, are operative to function in the same manner as the folding portions 22A and 23A, the connecting portion 24A, the press-receiving portion 25A, the engaging portion 26A and the slanted end plane 27A, which constitute the holding member 20A employed in the electrical connector 10 under the condition wherein the FPC 40 is inserted into the housing 11 of the electrical connector 10 through the opening 12 provided on the housing 11, and the folding portions 62B and 63B, the connecting portion 64B, the press-receiving portion 65B, the engaging portion 66B and the slanted end plane 67B, which constitute the holding member 60B employed in the electrical connector 50, are operative to function in the same manner as the folding portions 22B and 23B, the connecting portion 24B, the press-receiving portion 25B, the engaging portion 26B and the slanted end plane 27B, which constitute the holding member 20B employed in the electrical connector 10 under the condition wherein the FPC 40 is inserted into the housing 11 of the electrical connector 10 through the opening 12 provided on the housing 11. Accordingly, the upper end part of the engaging portion 66A of the holding member 60A, on which the slanted end plane 67A is formed, engages with the engaging edged recess 43A provided on the FPC 40 and the upper end part of the engaging portion 66B of the holding member 60B, on which the slanted end plane 67B is formed, engages with the engaging edged recess 43B provided on the FPC 40, so that the FPC 40 inserted in the housing 51 is held by the holding members 60A and 60B. As a result, the FPC 40 inserted in the housing 51 is prevented from getting out of the housing 51 unwillingly.

When the FPC 40 inserted in the housing 51 has reached a predetermined destination in the housing 51, the engaging edged recess 43A provided on the FPC 40 can not be observed through the vertical groove 87A provided on the front end portion of the housing 51 in a bird's-eye view of the electrical connector 50 fixed to the solid circuit board on which the housing 51 is mounted and similarly the engaging edged recess 43B provided on the FPC 40 can not be observed through the vertical groove 87B provided on the front end portion of the housing 51 in a bird's-eye view of the electrical connector 50 fixed to the solid circuit board on which the housing 51 is mounted. Thereby, the condition wherein the FPC 40 inserted in the housing 51 has reached the predetermined destination in the housing 51 can be easily confirmed by means of observing the FPC 40 inserted in the housing 51 through each of the vertical grooves 87A and 87B. If at least one of the engaging edged recesses 43A and 43B provided on the FPC 40 inserted in the housing 51 can be observed through at least one of the vertical grooves 87A and 87B provided on the front end portion of the housing 51, the FPC 40 inserted in the housing 51 has not reached the predetermined destination in the housing 51.

Under a condition wherein the FPC 40 inserted in the housing 51 takes up the predetermined destination in the housing 51 in the manner described above, each of the ground contacts 58 extending into the housing 51 from the belt-shaped plate portion 56 of the conductive shell 54 comes into resilient press-contact with the ground connecting portion 42 on the front surface of the FPC 40 from the side of the upper plate portion 57 of the conductive shell 54. As a result, the ground connecting portion 42 on the front surface of the FPC 40 inserted in the housing 51 is electrically connected through the ground contacts 58 with the grounded portion provided on the solid circuit board on which the housing 51 is mounted.

Further, each of the conductive contacts 53 arranged on the housing 51 also comes into resilient press-contact with a corresponding one of the signal connecting terminals 41 on the reverse surface of the FPC 40 from the side of the lower plate portion 61 of the conductive shell 54. As a result, the signal connecting terminals 41 on the reverse surface of the FPC 40 inserted in the housing 51 are electrically connected through the conductive contacts 53 with the circuit terminals provided on the solid circuit board on which the housing 51 is mounted.

Besides, the manipulatable portion 81A of the releasing member 80A provided on the housing 51 takes up the station shown in FIG. 16 and the pressing portion projecting from the manipulatable portion 81A of the releasing member 80A is positioned on the press-receiving portion 65A of the holding member 60A to be in contact with the slanted surface formed on the press-receiving portion 65A. Similarly, the manipulatable portion 81B of the releasing member 80B provided on the housing 51 takes up the station shown in FIG. 16 and the pressing portion projecting from the manipulatable portion 81B of the releasing member 80B is positioned on the press-receiving portion 65B of the holding member 60B to be in contact with the slanted surface formed on the press-receiving portion 65B.

Then, when the manipulatable portion 81A of the releasing member 80A is manipulated to move in the longitudinal direction of the housing 51 along which the conductive contacts 53 are arranged so as to approach the movement-limiting portion 85A, the manipulatable portion 81A is operative to move, together with the resilient engaging portion 70A, in the longitudinal direction of the housing 51 along which the conductive contacts 53 are arranged and the holding member 60A operates in the same manner as the holding member 20A operative to release the FPC 40 inserted in the housing 11 from the holding by the holding member 20A in the electrical connector 10 so as to release the FPC 40 inserted in the housing 51 from the holding by the holding member 60A. In addition, when the manipulatable portion 81B of the releasing member 80B is manipulated to move in the longitudinal direction of the housing 51 along which the conductive contacts 53 are arranged so as to approach the movement-limiting portion 85B, the manipulatable portion 81B is operative to move, together with the resilient engaging portion 70B, in the longitudinal direction of the housing 51 along which the conductive contacts 53 are arranged and the holding member 60B operates in the same manner as the holding member 20B operative to release the FPC 40 inserted in the housing 11 from the holding by the holding member 20B in the electrical connector 10 so as to release the FPC 40 inserted in the housing 51 from the holding by the holding member 60B.

On that occasion, since the width of the resilient strip forming the folding portion 62A is selected to be equal to or larger than the width of the resilient strip forming the folding portion 63A in the holding member 60A having the folding portions 62A and 63A and the connecting portion 64A constituting the resilient arm portion, the folding portion 63A is equal in rigidity to or smaller in rigidity than the folding portion 62A and therefore the engaging portion 66A of the holding member 60A can be easily and surely shifted in position downward with the press-receiving portion 65A of the holding member 60A having the slanted surface pressed downward by the pressing portion projecting from the manipulatable portion 81A of the releasing member 80A. Similarly, since the width of the resilient strip forming the folding portion 62B is selected to be equal to or larger than the width of the resilient strip forming the folding portion 63B in the holding member 60B having the folding portions 62B and 63B and the connecting portion 64B constituting the resilient arm portion, the folding portion 63B is equal in rigidity to or smaller in rigidity than the folding portion 62B and therefore the engaging portion 66B of the holding member 60B can be easily and surely shifted in position downward with the press-receiving portion 65B of the holding member 60B having the slanted surface pressed downward by the pressing portion projecting from the manipulatable portion 81B of the releasing member 80B.

The press-receiving portion 65A of the holding member 60A is operative to exert a retroactive force directed upward on the pressing portion projecting from the manipulatable portion 81A of the releasing member 80A. This retroactive force from the press-receiving portion 65A of the holding member 60A is transferred through the manipulatable portion 81A of the releasing member 80A to the upper end portion of the housing 51 and then absorbed by the left plate-like engaging portion 75A which is provided on the left front end portion of the conductive shell 54 for engaging with the shell-receiving portion 86A provided on the left end portion of the housing 51, so that each of the left end portion of the housing 51 and the left end portion of the conductive shell 54 is prevented from being subjected to undesirable deformation or the like.

The press-receiving portion 65B of the holding member 60B is operative to exert a retroactive force directed upward on the pressing portion projecting from the manipulatable portion 81B of the releasing member 80B. This retroactive force from the press-receiving portion 65B of the holding member 60B is transferred through the manipulatable portion 81B of the releasing member 80B to the upper end portion of the housing 51 and then absorbed by the right plate-like engaging portion 75B which is provided on the right front end portion of the conductive shell 54 for engaging with the shell-receiving portion 86B provided on the right end portion of the housing 51, so that each of the right end portion of the housing 51 and the right end portion of the conductive shell 54 is prevented from being subjected to undesirable deformation or the like.

The left plate-like engaging portion 75A provided on the conductive shell 54 is operative also to guide the manipulatable portion 81A of the releasing member 80A moving in the longitudinal direction of the housing 51 along which the conductive contacts 53 are arranged and similarly the right plate-like engaging portion 75B provided on the conductive shell 54 is operative also to guide the manipulatable portion 81B of the releasing member 80B moving in the longitudinal direction of the housing 51 along which the conductive contacts 53 are arranged.

As described above, when the manipulatable portion 81A of the releasing member 80A is manipulated, the engaging portion 66A of the holding member 60A shifts in position downward and disengages from the engaging edged recess 43A provided on the FPC 40 inserted in the housing 51 so that the FPC 40 is released from the holding by the holding member 60A, and when the manipulatable portion 81B of the releasing member 80B is manipulated, the engaging portion 66B of the holding member 60B shifts in position downward and disengages from the engaging edged recess 43B provided on the FPC 40 inserted in the housing 51 so that the FPC 40 is released from the holding by the holding member 60B. As a result, the FPC 40 is put in a condition to be able to get out of the housing 51.

In the case that a pair of engaging edged holes are provided on the FPC 40 in place of the engaging edged recesses 43A and 43B, the FPC 40 inserted in the housing 51 is held by the holding members 60A and 60B and then released by the releasing members 80A and 80B from the holding by the holding members 60A and 60B in the same manner as described above.

After that, when the manipulatable portion 81A of the releasing member 80A is released from the manipulation acted thereon, the manipulatable portion 81A is operative to return to the station shown in FIG. 16 with its own resilience and resilience of the resilient arm portion of the holding member 60A. With this returning movement of the manipulatable portion 81A of the releasing member 80A, the resilient arm portion of the holding member 60A is subjected to resilient restoring deformation and thereby each of the press-receiving portion 65A and the engaging portion 66A of the holding member 60A is shifted in position upward to return to the former position.

Similarly, when the manipulatable portion 81B of the releasing member 80B is released from the manipulation acted thereon, the manipulatable portion 81B is operative to return to the station shown in FIG. 16 with its own resilience and resilience of the resilient arm portion of the holding member 60B. With this returning movement of the manipulatable portion 81B of the releasing member 80B, the resilient arm portion of the holding member 60B is subjected to resilient restoring deformation and thereby each of the press-receiving portion 65B and the engaging portion 66B of the holding member 60B is shifted in position upward to return to the former position.

With the electrical connector 50 as described above, the same effect and advantages as those obtained with the electrical connector 10 can be obtained. In addition, in the electrical connector 50, since the resilient engaging portion 70A provided on the conductive shell 54 is operative to apply on the manipulatable portion 81A of the releasing member 80A the resilient force contributing to the returning movement of the manipulatable portion 81A when the manipulatable portion 81A of the releasing member 80A is manipulated to move in the longitudinal direction of the housing 51 along which the conductive contacts 53 are arranged for approaching the movement-limiting portion 85A and the resilient engaging portion 70B provided on the conductive shell 54 is operative to apply on the manipulatable portion 81B of the releasing member 80B the resilient force contributing to the returning movement of the manipulatable portion 81B when the manipulatable portion 81B of the releasing member 80B is manipulated to move in the longitudinal direction of the housing 51 along which the conductive contacts 53 are arranged for approaching the movement-limiting portion 85B, each of the manipulatable portion 81A of the releasing member 80A and the manipulatable portion 81B of the releasing member 80B is able to return much more surely and quickly to the former position after the manipulation acted thereon.

The invention claimed is:

1. An electrical connector comprising;

a housing made of insulator to be mounted on a solid circuit board and provided thereon with an opening through which a flat circuit device is inserted into the housing, a plurality of conductive contacts arranged on the housing to be electrically connected respectively with circuit terminals provided on the solid circuit board and positioned to correspond respectively to connecting terminals provided on the flat circuit device when the flat circuit device is inserted in the housing through the opening provided thereon, a conductive shell mounted on the housing to cover partially the housing and to be electrically connected with a grounded portion provided on the solid circuit board and provided with a holding member to extend into the housing for engaging with the flat circuit device inserted in the housing to hold the flat circuit device, and a releasing member formed with the housing to be movable with a manipulatable portion projecting from the inside to the outside of the housing at a portion of the housing neighboring the opening through which the flat circuit device is inserted into the housing and a pressing portion projecting from the manipulatable portion to engage with the holding member, wherein the manipulatable portion of the releasing member is formed to be movable in a direction along which the conductive contacts are arranged and the pressing portion of the releasing member is operative to move for pressing the holding member so as to cause the holding member to disengage from the flat circuit device inserted in the housing so that the flat circuit device is released from holding by the holding member when the manipulatable portion of the releasing member is moved in the direction along which the conductive contacts are arranged under a condition wherein the holding member is put in engagement with the flat circuit device inserted into the housing to hold the flat circuit device.

2. The electrical connector according to claim 1, wherein the holding member is provided with an engaging portion for engaging with an engaging edged portion provided on the flat circuit device inserted in the housing to hold the flat circuit device in the housing, a resilient arm portion for supporting the engaging portion to be shiftable in position and a press-receiving portion projecting from the resilient arm portion to form thereon a slanted surface inclined to the direction along which the conductive contacts are arranged, and the pressing portion of the releasing member engages with the slanted surface formed on the press-receiving portion of the holding member.

3. The electrical connector according to claim 2, wherein the pressing portion projecting from the manipulatable portion of the releasing member is operative to move in the direction along which the conductive contacts are arranged for pressing the slant surface formed on the press-receiving portion of the holding member to cause the holding member to shift in position, together with the engaging portion thereof, in a direction perpendicular to the direction along which the conductive contacts are arranged so that the engaging portion of the holding member disengages from the engaging edged portion provided on the flat circuit device inserted in the housing when the manipulatable portion of the releasing member is manipulated to move in the direction along which the conductive contacts are arranged under a condition wherein the engaging portion of the holding member is put in engagement with the engaging edged portion provided on the flat circuit device inserted in the housing.

4. The electrical connector according to claim 3, wherein the resilient arm portion of the holding member comprises first and second folding portions, each of which is shaped into a resilient strip with a predetermined width, the first folding portion is provided thereon with the engaging portion and the press-receiving portion, and the width of the resilient strip forming the second folding portion is selected to be equal to or larger than the width of the resilient strip forming the first holding portion.

5. The electrical connector according to claim 2, wherein the engaging portion of the holding member has an upper end thereof, on which a slanted end plane is formed to ascend gradually in a direction along which the flat circuit device is inserted into the housing through the opening provided thereon and the upper end of the engaging portion of the holding member is operative to engage with the engaging edged portion provided on the flat circuit device inserted in the housing.

6. The electrical connector according to claim 1, wherein the conductive shell is provided, in addition to the holding member, with a plate-like engaging portion operative to guide the manipulatable portion of the releasing member moving in the direction along which the conductive contacts are arranged and to be in contact with the manipulatable portion of the releasing member for absorbing a retroactive force exerted by the press-receiving portion of the holding member on the pressing portion projecting from the manipulatable portion of the releasing member.

7. The electrical connector according to claim 1, wherein the holding member is formed on each of end portions of the conductive shell opposite to each other in the direction along which the conductive contacts are arranged and the releasing member is provided on each of end portions of the housing opposite to each other in the direction along which the conductive contacts are arranged.

8. The electrical connector according to claim 1, wherein the conductive shell is formed thereon, in addition to the holding member, with a resilient engaging portion extending into the inside of the conductive shell for engaging with the manipulatable portion of the releasing member so as to apply on the manipulatable portion a resilient force contributing to a returning movement of the manipulatable portion when the manipulatable portion of the releasing member is moved in the direction along which the conductive contacts are arranged.

9. The electrical connector according to claim 8, wherein the resilient engaging portion formed on the conductive shell is shaped into a cantilever.

10. The electrical connector according to claim 8, wherein the manipulatable portion of the releasing member is provided thereon with an engaging recess with which the resilient engaging portion formed on the conductive shell engages.

11. The electrical connector according to claim 10, wherein the engaging recess provided on the manipulatable portion of the releasing member constitutes a groove-shaped portion.

12. An electrical connector according to claim 8, wherein the holding member and the resilient engaging portion are formed on each of end portions of the conductive shell opposite to each other in the direction along which the conductive contacts are arranged and the releasing member is provided on each of end portions of the housing opposite to each other in the direction along which the conductive contacts are arranged.

13. The electrical connector according to claim 1, wherein the housing is provided with a movement-limiting portion which is positioned in the vicinity of the manipulatable portion of the releasing member for limiting a movement of the manipulatable portion of the releasing member in the direction with which the conductive contacts are arranged.

* * * * *